US008851603B2

(12) United States Patent
Hashiguchi

(10) Patent No.: US 8,851,603 B2
(45) Date of Patent: Oct. 7, 2014

(54) DRIVING DEVICE FOR DRIVING LIQUID DISCHARGE HEAD, RECORDING APPARATUS, AND RECORDING METHOD

(75) Inventor: Takuji Hashiguchi, Kyoto (JP)

(73) Assignee: Kyocera Corporation, Kyoto (JP)

( * ) Notice: Subject to any disclaimer, the term of this patent is extended or adjusted under 35 U.S.C. 154(b) by 87 days.

(21) Appl. No.: 13/637,581

(22) PCT Filed: Mar. 28, 2011

(86) PCT No.: PCT/JP2011/057662

§ 371 (c)(1),
(2), (4) Date: Sep. 26, 2012

(87) PCT Pub. No.: WO2011/118833

PCT Pub. Date: Sep. 29, 2011

(65) Prior Publication Data

US 2013/0016146 A1 Jan. 17, 2013

(30) Foreign Application Priority Data

Mar. 26, 2010 (JP) ..... 2010-072786

(51) Int. Cl.

| | |
|---|---|
| ***B41J 29/38*** | (2006.01) |
| ***B41J 2/14*** | (2006.01) |
| ***B41J 2/045*** | (2006.01) |
| ***B41J 2/155*** | (2006.01) |

(52) U.S. Cl.

CPC ..... *B41J 2/14209* (2013.01); *B41J 2202/20* (2013.01); *B41J 2002/14459* (2013.01); *B41J 2/04581* (2013.01); *B41J 2/04573* (2013.01); *B41J 2/155* (2013.01); *B41J 2002/14225* (2013.01)

USPC ..... 347/10; 347/5; 347/9

(58) Field of Classification Search

CPC .. B41J 2/0451; B41J 2/04541; B41J 2/04543; B41J 2/0458; B41J 2/04581; B41J 2/4588; B41J 2/04593; B41J 2/17546; B41J 2/2135; B41J 29/393

USPC ..... 347/9, 10, 19, 5

See application file for complete search history.

(56) References Cited

U.S. PATENT DOCUMENTS

| | | | | |
|---|---|---|---|---|
| 5,724,077 | A | 3/1998 | Murata | |
| 6,371,587 | B1 * | 4/2002 | Chang | 347/11 |

(Continued)

FOREIGN PATENT DOCUMENTS

| | | |
|---|---|---|
| JP | 06115101 | 4/1994 |
| JP | 2000190476 | 7/2000 |

(Continued)

OTHER PUBLICATIONS

International Search Report, PCT/US2011/057662, Apr. 19, 2011, 2 pp.

(Continued)

*Primary Examiner* — Manish S Shah
*Assistant Examiner* — Roger W Pisha, II
(74) *Attorney, Agent, or Firm* — Volpe and Koenig, P.C.

(57) ABSTRACT

A driving device, and a liquid discharge head and a recording apparatus using the driving device are provided which permit precise printing under various conditions. The driving device includes a latch signal generation circuit for generating a latch signal every Tc seconds; a delay time retention circuit for retaining data of delay times of less than Tc seconds; a plurality of first latch circuits which are capable of retaining one-line pixel data, and latch pixel data from outside by the latch signal; a plurality of second latch circuits which are divided into a plurality of second latch circuit groups, and latch pixel data retained in the plurality of first latch circuits after the delay time of data retained in the delay time retention circuit for each of the second latch circuit groups is passed after the latch signal is transmitted; and a driving signal transmission circuit.

11 Claims, 11 Drawing Sheets

(56) References Cited

U.S. PATENT DOCUMENTS

| | | | | |
|---|---|---|---|---|
| 6,460,976 | B1 | 10/2002 | Oikawa | |
| 2001/0002836 | A1* | 6/2001 | Tanaka et al. | 347/11 |
| 2002/0101465 | A1* | 8/2002 | Maeda | 347/12 |
| 2003/0011653 | A1* | 1/2003 | Oikawa et al. | 347/15 |
| 2003/0218646 | A1* | 11/2003 | Usuda et al. | 347/9 |
| 2004/0056909 | A1* | 3/2004 | Takahashi et al. | 347/5 |
| 2004/0223016 | A1* | 11/2004 | Koyama | 347/12 |
| 2005/0190221 | A1 | 9/2005 | Iriguchi | |
| 2007/0211092 | A1* | 9/2007 | Shingyohuchi et al. | 347/10 |
| 2008/0060198 | A1 | 3/2008 | Nakashima | |
| 2009/0040253 | A1 | 2/2009 | Miyasaka | |
| 2009/0207200 | A1* | 8/2009 | Tamura | 347/9 |
| 2010/0103210 | A1* | 4/2010 | Sayama | 347/10 |

FOREIGN PATENT DOCUMENTS

| | | | |
|---|---|---|---|
| JP | 2002002046 | | 8/2002 |
| JP | 2003054015 | | 2/2003 |
| JP | 2003305852 | | 10/2003 |
| JP | 2005238728 | | 9/2005 |
| JP | 2008062552 | A | 3/2008 |
| JP | 2008155541 | A | 7/2008 |
| JP | 2008221729 | | 9/2008 |
| JP | 2009039658 | | 2/2009 |
| JP | 2009233941 | A | 10/2009 |
| JP | 2009285921 | A | 12/2009 |

OTHER PUBLICATIONS

Statement of Relevance of Non-English References, U.S. Appl. No. 13/637,581, 1 pp.

Japanese Office Action, Japanese Patent Application No. 2012/507124, Jun. 4, 2013, 2 pp.

* cited by examiner

Fig. 7 (a-1)
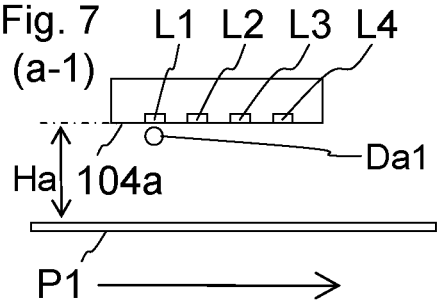
Fig. 7 (b-1)
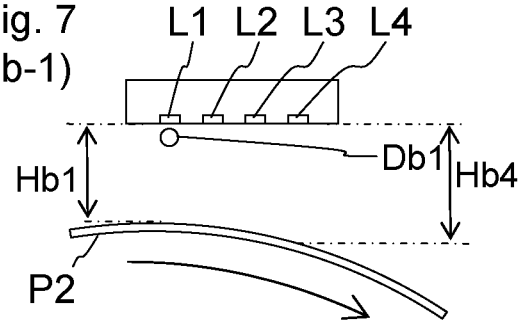
Fig. 7 (a-2)
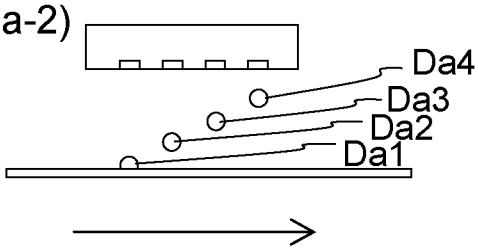
Fig. 7 (b-2)
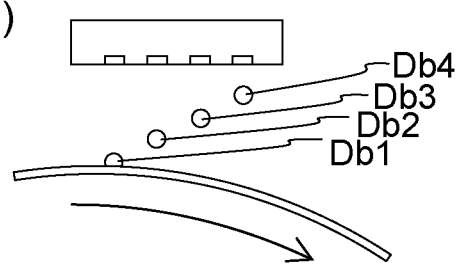
Fig.7 (a-3)
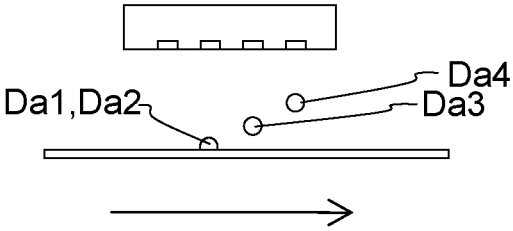
Fig. 7 (b-3)
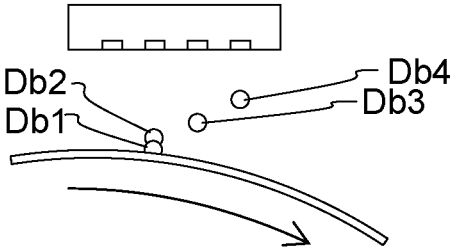
Fig. 7 (a-4)
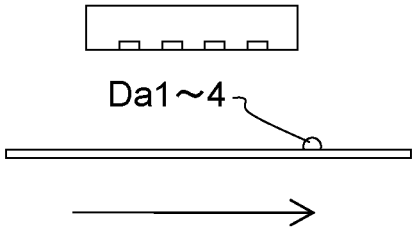
Fig. 7 (b-4)
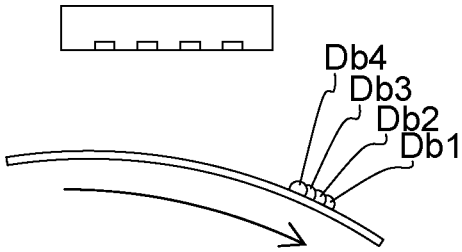

DRIVING DEVICE FOR DRIVING LIQUID DISCHARGE HEAD, RECORDING APPARATUS, AND RECORDING METHOD

FIELD OF INVENTION

The present invention relates to a driving device for driving a liquid discharge head for discharging liquid drops, and a liquid discharge head and a recording apparatus using the driving device.

BACKGROUND

Recently, printing apparatuses using inkjet recording method, such as inkjet printers and inkjet plotters, have been widely used in not only printers for general consumers but also industrial purposes of color filter manufacturing, such as for electronic circuit formation and liquid crystal displays, and organic EL display manufacturing.

In the inkjet printing apparatus, liquid discharge heads for discharging liquid are mounted as a printing head. As this type of print head, thermal head method and piezoelectric method are generally known. That is, in the thermal head method, a heater as a pressing means is installed in an ink passage filled with ink, and the ink is heated and boiled by the heater. The ink is pressed by air bubbles occurred in the ink passage, and is then discharged as liquid drops through ink discharge pores. In the piezoelectric method, a part of the ink passage filled with ink is bendingly displaced by a displacement element. The ink in the ink passage is mechanically pressed and is discharged as liquid drops through the ink discharge pores.

The liquid discharge head can employ either serial method or line method. That is, with the serial method, recording is carried out while the liquid discharge head is moved in a direction (a main scanning direction) orthogonal to a transport direction of a recording medium (a sub scanning direction). With the line method, recording is carried out on a recording medium transported in the sub scanning direction in a state in which a liquid discharge head being longer in the main scanning direction than a recording medium is fixed. The line method has an advantage of permitting high speed recording because unlike the serial method, there is no need to move the liquid discharge head.

Even the liquid discharge head of either the serial method or the line method is required to increase the density of the liquid discharge pores for discharging the liquid drops which are formed in the liquid discharge head, in order to print the liquid drops with high density.

For example, there is known a liquid discharge head that is configured by laminating a passage member including a manifold (common passage) and liquid discharge pores connected from the manifold via a plurality of liquid pressing chambers, and an actuator unit having a plurality of displacement elements respectively disposed so as to cover the liquid pressing chambers (refer to, for example, patent document 1). In this liquid discharge head, the liquid pressing chambers respectively connected to the plurality of liquid discharge pores are arranged in a matrix shape, and the displacement elements of the actuator unit arranged to cover the liquid pressing chambers are displaced, thereby constituting a plurality of linear liquid discharge pore rows parallel to each other. Ink is discharged from the liquid discharge pores arranged at equal intervals in one direction so as not to be overlapped with each other in a direction orthogonal to the one direction, thus permitting printing at a resolution of 600 dpi in the main scanning direction and at a resolution of 600 dpi in the sub scanning direction.

PRIOR ART DOCUMENT

Patent Document

Patent document 1: Japanese Unexamined Patent Publication No. 2003-305852

SUMMARY

Problems to be Solved by the Invention

When printing is performed using the liquid discharge head described in the patent document 1, it can be considered to retain data in the same number of latch circuits as the liquid discharge pores, and to transmit a driving signal for driving a pressing section for pressing the liquid pressing chambers connected to the individual liquid discharge pores. Under this configuration, the timing of discharge is limited, and in some cases it may be difficult to produce satisfactory images.

A specific problem is described with reference to the timing chart of FIG. 10. FIG. 10 is the timing chart of the control section including the same number of latch circuits as the liquid discharge pores, and a driving signal transmission circuit for transmitting a driving signal to a driving section on the basis of pixel data of images retained at the latch circuits. The latch circuits latch pixel data from outside by a latch signal (LATCH) every Tc seconds. After a certain delay time has passed from the latch signal, the driving signal transmission circuit transmits the driving signal on the basis of the data retained at the latch circuits. The driving signal transmitted is, for example, a discharge driving signal having a length of T seconds when the liquid is discharged, and a non-discharge driving signal unaccompanied by a change in driving voltage when the liquid is not discharged.

In this case, the delay time is limited to a range of 0 to (Tc−T) seconds. The shortest delay time is 0 second (actually requiring a system clock passage until a latch operation is terminated). The longest delay time is (Tc−T) seconds. The transmission of a driving signal transmitted from time t1 when (Tc−T) seconds have elapsed from time t0 when the latch signal has been transmitted is completed before the pixel data retained at the latch circuits are replaced with the next data. Consequently, the discharge or non-discharge is normally performed.

In contrast, if the driving signal is transmitted from time t2 when a period of time longer than (Tc−T) has elapsed from time t0, pixel data retained at the latch circuits are replaced with the next pixel data by the next latch signal, at time t3 when Tc seconds have elapsed from the first latch signal. If the value of the retained pixel data is different, the driving signal transmitted to the driving section is changed, thus failing to perform the normal discharge or non-discharge.

A delay needs to be changed when performing printing on a recording medium transported on a flat surface, and when performing printing on an unflat recording medium, such as a recording medium transported on a cylindrical drum. The delay also needs to be changed in case of printing at a resolution of 600×600 dpi (hereinafter, A×B dpi denotes A dpi in the main scanning direction and B dpi in the sub scanning direction), and in case of printing at a resolution of 600×450 dpi. In these cases, when settable time as the delay time is limited to the range of 0 to (Tc−T) seconds, it cannot help but drive with a delay time different from an original optimum delay time. This consequently causes displacement of landing position on the recording medium, thus making it difficult to perform satisfactory printing.

Therefore, an object of the present invention is to provide a driving device for driving a liquid discharge head, and a liquid discharge head and a recording apparatus using the driving device, each of which permits precise printing under various conditions.

Means for Solving the Problems

The driving device for driving the liquid discharge head according to the present invention includes a latch signal generation circuit for generating a latch signal every Tc seconds; a delay time retention circuit for retaining data of delay times of less than Tc seconds; a plurality of first latch circuits which are capable of retaining one-line pixel data, and latch pixel data from outside by the latch signal; a plurality of second latch circuits which are divided into a plurality of second latch circuit groups, and latch pixel data retained in the plurality of first latch circuits after the delay time of data retained in the delay time retention circuit for each of the second latch circuit groups is passed after the latch signal is transmitted; and a driving signal transmission circuit which retains data of driving signals having a length of Tc seconds or less, and transmits the driving signals after a total time of the delay time of the data retained in the delay time retention circuit for each of the second latch circuit groups and a predetermined time of less than Tc seconds is passed after the latch signal is transmitted.

The recording apparatus according to the present invention includes a liquid discharge pore opening surface having a plurality of liquid discharge pores opened therein in which the plurality of linear liquid discharge pores constitute a plurality of linear liquid discharge pore rows parallel to each other, and are arranged at equal intervals in one direction so as not to be overlapped with each other in a direction orthogonal to the one direction; a plurality of driving sections for allowing the liquid discharge pores to deliver liquid; a transport section for transporting a recording medium with respect to the liquid discharge pore opening surface; a memory section for retaining pixel data constituting an image; and a control section including (i) a latch signal generation circuit for generating a latch signal every Tc seconds, (ii) a delay time retention circuit for retaining data of delay times of less than Tc seconds, (iii) a plurality of first latch circuits which are capable of retaining pixel data whose number is identical with that of the plurality of liquid discharge pores, and latch pixel data from the memory section by the latch signal, (iv) a plurality of second latch circuits which are divided into a plurality of second latch circuit groups, and latch pixel data retained in the plurality of first latch circuits after the delay time of the data retained in the delay time retention circuit for each of the second latch circuit groups is passed after the latch signal is transmitted, and (v) a driving signal transmission circuit which retains data of driving signals having a length of Tc seconds or less, and concurrently transmits the driving signals on a basis of the pixel data retained in the second latch circuits of one of the second latch circuit groups to the plurality of driving sections corresponding to one of the liquid discharge pore rows, after a total time of the delay time of data retained in the delay time retention circuit for each of the second latch circuit groups and a predetermined time of less than Tc seconds is passed after the latch signal is transmitted.

The data of the delay time retained in the delay time retention circuit for each of the second latch circuit groups are preferably data in which the delay time becomes longer when a flight distance of liquid becomes shorter, wherein the flight distance is a distance from the liquid discharge pores of the liquid discharge pore row corresponding to the second latch circuit group to the recording medium on which a discharged liquid lands.

The driving signal transmission circuit preferably retains data of the plurality of driving signals depending on a liquid discharge amount and the flight distance. The data of the driving signals are preferably data in which an initial standby time until an initial voltage change occurs in the driving signals becomes longer with increasing the liquid discharge amount. When a comparison is made between the data of the driving signals having different flight distances, the data preferably have a larger difference of the initial standby time in the driving signals having different liquid discharge amounts as the flight distance becomes longer.

The driving signal transmission circuit preferably retains data of the plurality of driving signals depending on a liquid discharge amount. The data of the driving signals are preferably data in which an initial standby time until an initial voltage change occurs in the driving signals becomes longer with increasing the liquid discharge amount.

The driving signal transmission circuit preferably retains a plurality of data of the driving signals having different initial standby times until an initial voltage change occurs in the driving signals, and transmits the driving signals having the different initial standby times as the driving signals transmitted to the driving sections corresponding to the liquid discharge pores adjacent to each other in the liquid discharge pore row.

The recording method according to the present invention uses the recording apparatus including a liquid discharge pore opening surface having a plurality of liquid discharge pores opened therein in which the plurality of linear liquid discharge pores constitute a plurality of linear liquid discharge pore rows parallel to each other, and are arranged at equal intervals in one direction so as not to be overlapped with each other in a direction orthogonal to the one direction; a plurality of driving sections; and control section including (i) a plurality of first latch circuits capable of retaining pixel data whose number is identical with that of the plurality of liquid discharge pores, (ii) a plurality of second latch circuits respectively connected to the plurality of first latch circuits, and (iii) a driving signal transmission circuit which retains data of driving signals having a length of Tc seconds or less, and transmits the driving signals to the plurality of driving sections. The recording method is configured to deliver liquid to a recording medium transported relative to the liquid discharge pore opening surface. The recording method includes dividing the plurality of second latch circuits into a plurality of second latch circuit groups; individually setting delay times of Tc seconds or less to the plurality of second latch circuit groups; generating a latch signal every Tc seconds; latching pixel data into the plurality of first latch circuits; latching the pixel data retained in the first latch circuits into the plurality of second latch circuits after the delay time set for each of the second latch circuit groups is passed from the latch signal is transmitted; and concurrently transmitting the driving signals on a basis of the pixel data retained in the second latch circuits of one of the second latch circuit groups to the plurality of driving sections corresponding to one of the liquid discharge pores row after a total time of the delay time set for each of the second latch circuit groups and a predetermined time of Tc seconds or less is passed after the latch signal is transmitted.

The recording method preferably includes setting the delay times set for each of the second latch circuit groups so as to be longer when a flight distance of liquid becomes shorter, wherein the flight distance is a distance from the liquid discharge pores of the liquid discharge pore rows corresponding to the second latch circuit group to the recording medium on which a discharged liquid lands.

The recording method preferably includes preparing, as the data of the driving signals, a plurality of kinds of data depending on a liquid discharge amount and the flight distance; and using, as the driving signals, driving signals wherein an initial standby time until an initial voltage change occurs in the driving signals becomes longer with increasing the liquid discharge amount and wherein when a comparison is made between the driving signals having different flight distances, a difference of the initial standby time in the driving signals having different liquid discharge amounts increases with increasing the flight distance.

The recording method preferably includes preparing, as the data of the driving signals, a plurality of kinds of data depending on a liquid discharge amount; and using, as the driving signals, driving signals wherein an initial standby time until an initial voltage change occurs in the driving signals becomes longer with increasing the liquid discharge amount.

The recording method preferably includes preparing, as the data of the driving signals, a plurality of kinds of data having different initial standby times until an initial voltage change occurs in the driving signals; and using the driving signals having the different initial standby times as the driving signals transmitted to the driving sections corresponding to the liquid discharge pores adjacent to each other in the liquid discharge pore row.

Effects of the Invention

In the driving device for driving the liquid discharge head according to the present invention, even when the driving signal is transmitted at any timing, the data at the second latch circuits are not subject to rewriting during transmission of the driving signal. This ensures the normal driving signal.

In the recording apparatus according to the present invention, even when the driving signal is transmitted at any timing, the data at the second latch circuits are not subject to rewriting during transmission of the driving signal. This ensures the normal driving signal, thus achieving satisfactory recording.

In the recording method according to the present invention, even when the driving signal is transmitted at any timing, the data at the second latch circuit are not subject to rewriting during transmission of the driving signal. This ensures the normal driving signal, thus achieving satisfactory recording.

BRIEF DESCRIPTION OF THE DRAWINGS

FIG. 6(*b*) is a schematic diagram of some of a driving device for driving liquid discharge heads which controls discharge from the liquid discharge pores shown in FIG. 6(*a*);

FIGS. 7(*a*-1) to 7(*a*-4) are longitudinal cross sections during printing on a flat surface shaped recording medium; FIGS. 7(*b*-1) to 7(*b*-4) are longitudinal cross sections during printing on a convex surface shaped recording medium;

DETAILED DESCRIPTION OF THE PREFERRED EMBODIMENTS

Figure 1:
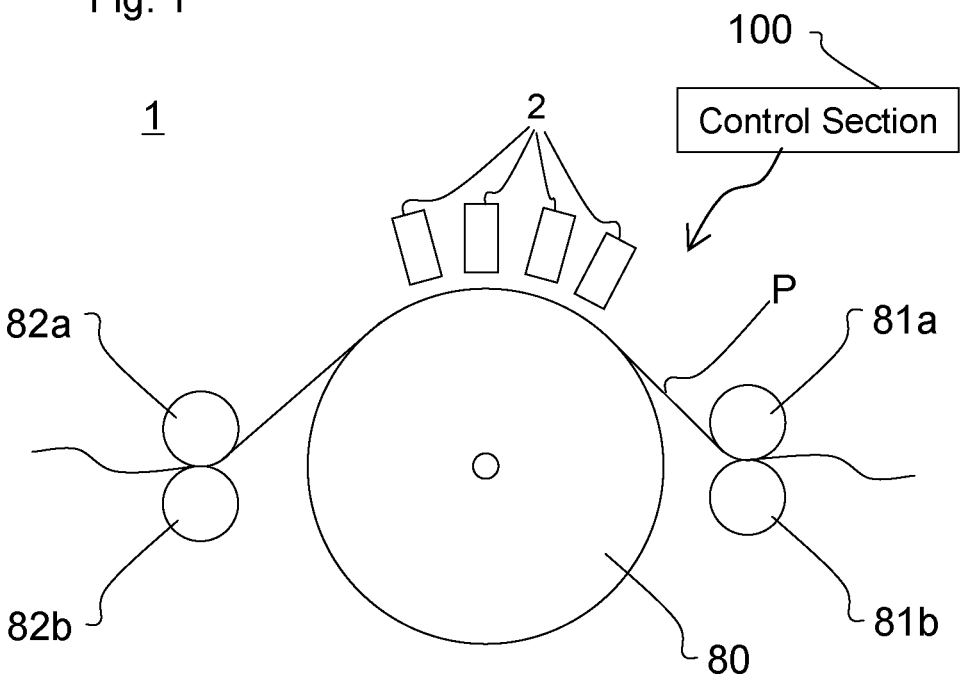
FIG. 1 is a schematic block diagram showing a printer that is a recording apparatus according to an embodiment of the present invention.

FIG. 1 is the schematic block diagram of the color inkjet printer that is the recording apparatus including the liquid discharge heads according to an embodiment of the present invention. The color inkjet printer 1 (hereinafter referred to as the printer 1) includes four liquid discharge heads 2. These liquid discharge heads 2 are arranged along a transport direction of a recording medium P, such as paper, and are fixed to the printer 1. The liquid discharge heads 2 have a shape being long and narrow in a direction in which they extend from the near side to the far side in FIG. 1. In some cases this direction is referred to as a longitudinal direction.

In the printer 1, the printer heads 2 perform printing on the recording medium P during the time the recording medium P is passed between rollers 81*a* and 81*b*, and is transported along a cylindrical drum 80, and is passed between rollers 82*a* and 82*b*, and then transported along the drum 80. Although the cylindrical drum 80 is illustrated here as a convex shaped transport surface, the convex shaped transport surface may have other shape as long as it is projected toward the liquid discharge heads 2. The printer 1 is also provided with a control section 100 for controlling operations in the parts of the printer 1, such as the liquid discharge heads 2 and the drum.

These four liquid discharge heads 2 are arranged close to each other along the transport direction of the recording medium P. Each of these liquid discharge heads 2 has a head body 13 at the lower end thereof. The lower surface of the head body 13 serves as a liquid discharge pore opening surface 4*a* with a large number of liquid discharge pores 8 for discharging liquid (refer to FIG. 5). Although the illustrated liquid discharge pore opening surface 4*a* is a flat surface, it may be curved in a transverse direction instead of being curved in the longitudinal direction. For example, a surface curved according to the diameter of the standardly used drum 80 eliminates the need for delay control therefor.

Liquid drops (ink) of identical color are discharged from the liquid discharge pores 8 disposed in the single liquid discharge head 2. These liquid discharge pores 8 of each of these liquid discharge heads 2 are arranged at equal intervals in one direction (a direction parallel to the recording medium P and orthogonal to the transport direction of the recording medium P, namely, the longitudinal direction of the liquid discharge head 2). This permits printing in the one direction without any space. The colors of liquids discharged from these liquid discharge heads 2 are respectively magenta (M), yellow (Y), cyan (C), and black (K). Each of these liquid discharge heads 2 is disposed between the liquid discharge pore opening surface 4*a* of the lower surface of the head body 13 and the transport surface of the drum 80 with a minute space interposed therebetween.

The recording medium P transported by the drum 80 is passed through the space between the liquid discharge heads 2 and the drum 80. At that time, the liquid drops are discharged from the head body 13 constituting the liquid discharge heads 2 to the upper surface of the recording medium P. Consequently, a color image on the basis of image data stored by the control section 100 is formed on the upper surface of the recording medium P.

Next, the liquid discharge heads 2 of the present invention are described below. Each of the liquid discharge heads 2 includes the liquid discharge head 13 and a casing. The casing is made of metal, and has at a part thereof an open hole to allow passage of a signal cable for transmitting the driving signal. The hole allows passage of the signal cable configured to transmit the driving signal which is connected to the control section 100. The hole is configured to be closed by a resin lid or the like. The liquid is supplied from outside to the liquid discharge head body 13 via a tube or the like.

The driving signal transmitted from the control section 100 drives a displacement element 50 of a piezoelectric actuator unit 21 described later so as to press the liquid in the passage member 4, thereby discharging liquid drops. The control section 100 includes driver ICs respectively connected to the control section 100 via a signal cable from certain portions outside the liquid discharge heads 2. These driver ICs are driving devices described later. Pixel data transmitted from the control section 100 located outside the liquid discharge heads 2 are processed by the driver ICs as the driving devices, and the driving signal after being subjected to the processing is configured to drive the displacement element 50 via a signal transmission section. The signal transmission section is, for example, a flexible flat cable.

Figure 2:
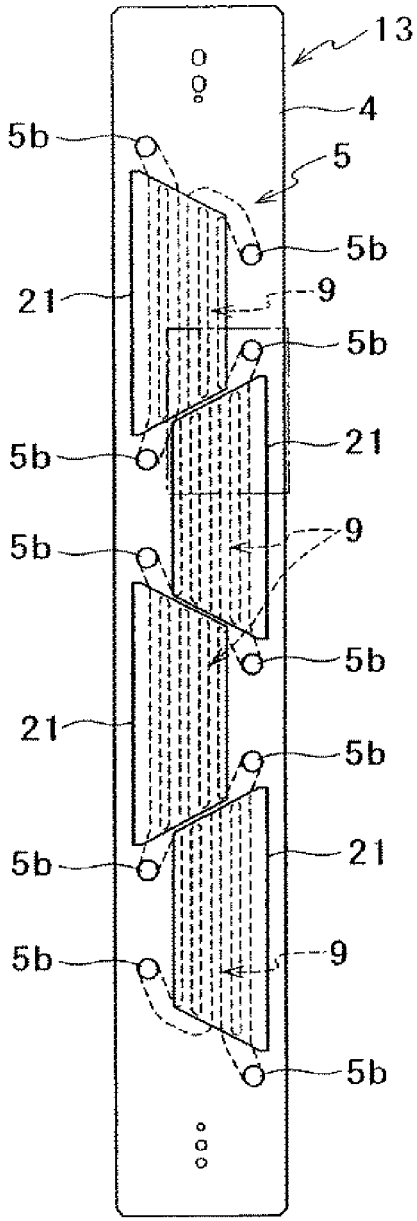
FIG. 2 is a top plan view of a passage member and a piezoelectric actuator which constitute a liquid discharge head in FIG. 1.
Figure 3:
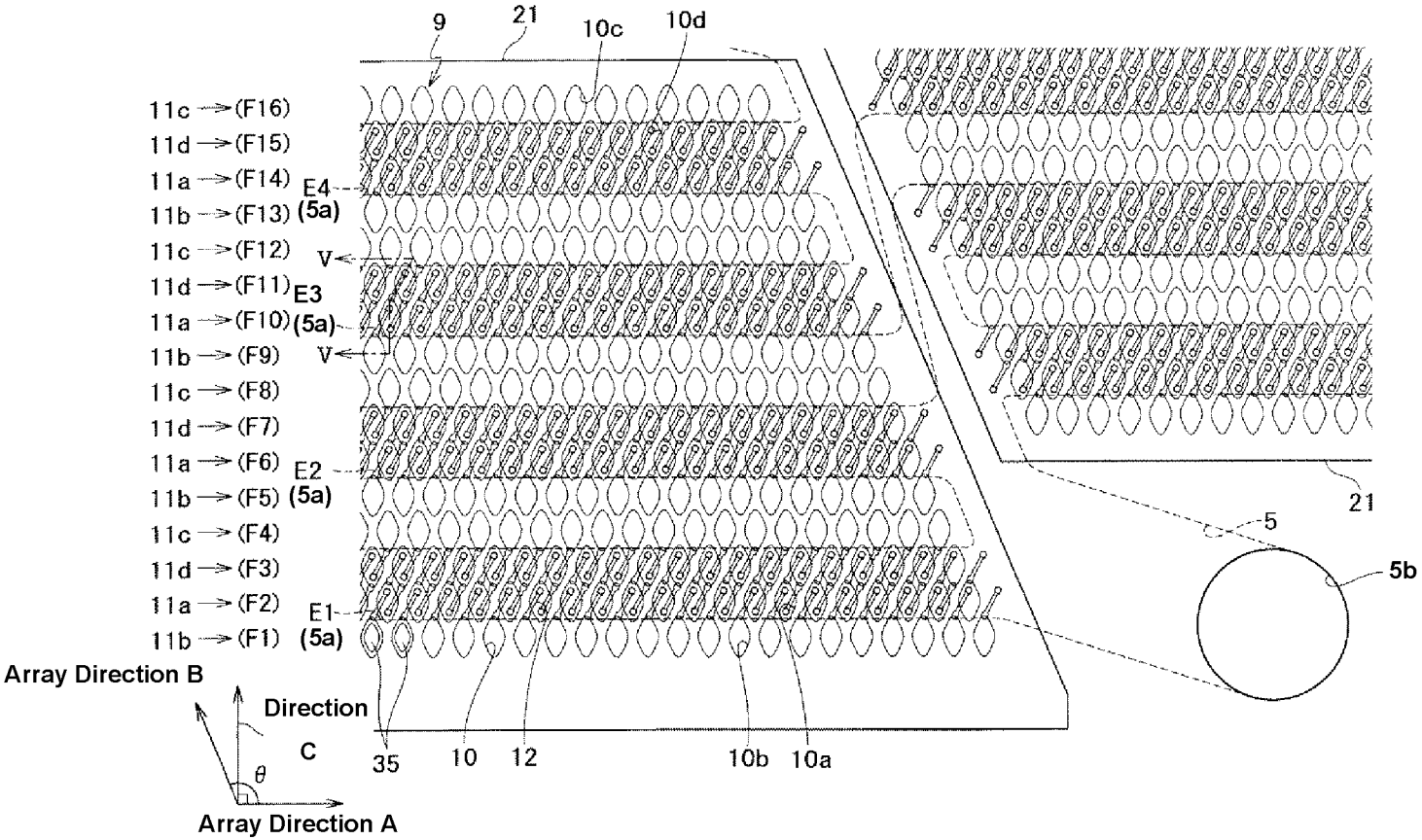
FIG. 3 is one enlarged view of a region surrounded by chain lines in FIG. 2.
Figure 4:
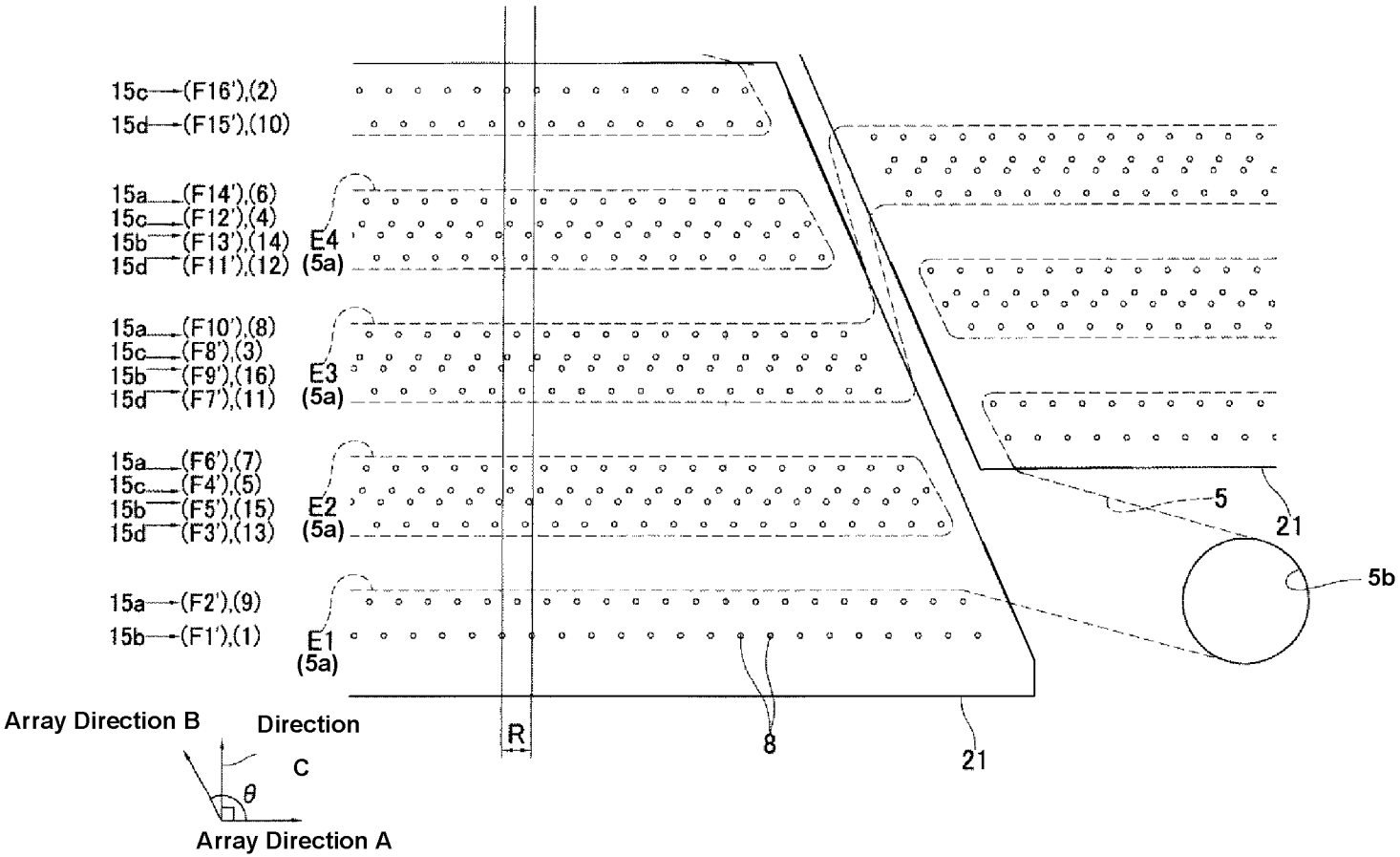
FIG. 4 is another enlarged view of the region surrounded by the chain lines in FIG. 2, from which some passages are omitted for the sake of explanation.
Figure 5:
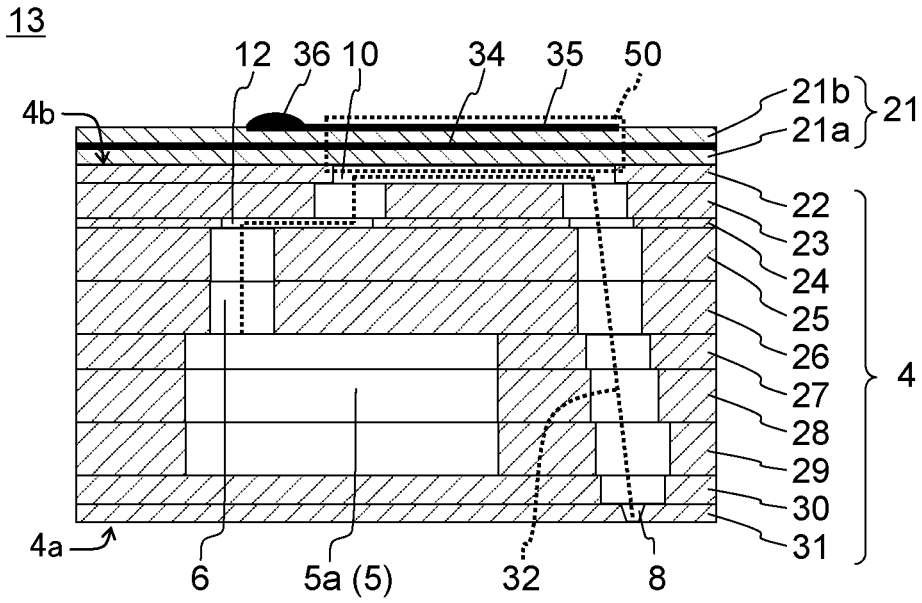
FIG. 5 is a longitudinal cross section taken along the line V-V in FIG. 3.

Next, the passage member 4 constituting the liquid discharge heads of the present invention is described below. FIG. 2 is the top plan view showing the passage member 4 and the piezoelectric actuator 21 of the liquid discharge head body 13. FIG. 3 is the enlarged top plan view of the region surrounded by the chain lines in FIG. 2, namely, some of the liquid deliver head body 13. FIG. 4 is the enlarged perspective view at the same position as FIG. 3, from which some passages are omitted in order to facilitate recognition of the positions of the liquid discharge pores 8. In FIGS. 3 and 4, the liquid pressing chambers 10 (liquid pressing chamber groups 9), apertures 12, and the liquid discharge pores 8, which are located below the piezoelectric actuator unit 21 and therefore should be drawn by broken lines, are drawn by solid lines for the sake of clarification. FIG. 5 is the longitudinal cross sectional view taken along the line V-V in FIG. 3.

The head body 13 includes the flat plate-shaped passage member 4, and the piezoelectric actuator unit 21 which includes a pressing section and is disposed on the passage member 4. The piezoelectric actuator unit 21 has a trapezoidal shape, and is disposed on the upper surface of the passage member 4 so that a pair of parallel opposite sides of the trapezoidal shape are parallel to the longitudinal direction of the passage member 4. Two piezoelectric actuator units 21 along each of two virtual straight lines parallel to the longitudinal direction of the passage member 4, namely, a total of these four piezoelectric actuator units 21 are disposed in a staggered arrangement in their entirety on the passage member 4. Oblique sides of the piezoelectric actuator units 21 adjacent to each other on the passage member 4 are partially overlapped with each other in the transverse direction of the passage member 4. The liquid drops discharged from these two piezoelectric actuator units 21 mixingly land on a region to be subjected to printing by driving the piezoelectric actuator units 21 corresponding to the overlapped portion.

The manifolds 5 are formed inside the passage member 4. These manifolds 5 extend along the longitudinal direction of the passage member 4 and have a narrow long shape. Openings 5*b* of these manifolds 5 are formed in the upper surface of the passage member 4. The five openings 5*b* are formed along each of two straight lines (virtual lines) parallel to the longitudinal direction of the passage member 4, namely, a total of the ten openings are formed there. These openings 5*b* are formed at locations other than the region in which the four piezoelectric actuator units 21 are disposed. The liquid is supplied from an unshown liquid tank to these manifolds 5 through these openings 5*b*.

The manifolds 5 formed in the passage member 4 are branched into a plurality of pieces (in some cases, the manifolds 5 located at the branched portions are called sub manifolds 5*a*, and the manifolds 5 extending from the opening 5*b* to the sub manifolds 5*a* are called liquid supply paths 5*c*). The liquid supply paths 5*c* connected to the openings 5*b* extend along the oblique sides of the piezoelectric actuator units 21, and are disposed so as to intersect the longitudinal direction of the passage member 4. In a region held between the two piezoelectric actuator units 21, the single manifold 5 is shared by the piezoelectric actuator units 21 adjacent to each other, and the sub manifolds 5*a* are branched from both sides of the manifold 5. These sub manifolds 5*a* are adjacent to each other in the region opposing to the individual piezoelectric actuator units 21 located inside the passage member 4, and extend in the longitudinal direction of the head body 13. That is, both ends of the sub manifold 5*a* are connected to the liquid supply path 5*c*.

The passage member 4 includes four liquid pressing chamber groups 9 in each of which the plurality of liquid pressing chambers 10 are formed in a matrix shape (namely, in a regular two-dimensional shape). Each of these liquid pressing chambers 10 is a hollow region having a substantially rhombus planar shape whose corners are rounded. These liquid pressing chambers 10 are configured to open in the upper surface of the passage member 4. These liquid pressing chambers 10 are arranged over substantially the entire surface of a region on the upper surface of the passage member 4 which is opposed to the piezoelectric actuator units 21. Therefore, each of the individual liquid pressing chamber groups 9 formed by these liquid pressing chambers 10 occupies a region having substantially the same size and shape as the piezoelectric actuator unit 21. The openings of these liquid pressing chambers 10 are closed by the piezoelectric actuator units 21 adhered to the upper surface of the passage member 4.

In the present embodiment, as shown in FIG. 3, the manifolds 5 are branched into the sub manifolds 5*a* of four rows E1 to E4 arranged in parallel to each other in the transverse direction of the passage member 4. The liquid pressing chambers 10 connected to these sub manifolds 5*a* constitute rows of the liquid pressing chambers 10 arranged at equal intervals in the longitudinal direction of the passage member 4. These rows are arranged in four rows parallel to each other in the transverse direction. The two rows in which the liquid pressing chambers 10 connected to the sub manifolds 5*a* are respectively arranged on both sides of the sub manifold 5*a*.

On the whole, the liquid pressing chambers 10 connected from the manifolds 5 constitute the rows of the liquid pressing chambers 10 arranged at equal intervals in the longitudinal direction of the passage member 4, and 16 rows thereof are arranged in parallel to each other in the transverse direction.

The number of the liquid pressing chambers 10 per liquid pressing chamber row corresponds to the external shape of the displacement element 50 that is the pressing section, and the liquid pressing chambers 10 are arranged so that the number thereof is gradually decreased from the long side to short side of the external shape. The liquid discharge pores 8 are also arranged similarly. This permits image formation at a resolution of 600 dpi in the longitudinal direction on the whole.

That is, when the liquid discharge pores 8 are projected orthogonally to virtual straight lines parallel to the longitudinal direction of the passage member 4, the four liquid discharge pores 8 respectively connected to the four sub manifolds 5*a*, namely, a total of 16 liquid discharge pores 8 are arranged at equal intervals of 600 dpi in a range R of the virtual straight lines shown in FIG. 3. The individual passages 32 are connected to each of these sub manifolds 5*a* at intervals corresponding to 150 dpi on average. That is, when the liquid discharge pores 8 for 600 dpi are designed to be dividingly connected to four rows of the sub manifolds 5*a*, all the individual passages 32 connected to their respective sub manifolds 5*a* are not connected to each other at equal intervals. Therefore, the individual passages 32 are formed at intervals of an average of 170 μm or less (for 150 dpi, they are formed at intervals of 25.4 mm/150=169 μm) in the extending direction of the sub manifolds 5*a*, namely, in the main scanning direction.

Individual electrodes 35 described later are respectively formed at locations opposing to the liquid pressing chambers 10 on the upper surface of the piezoelectric actuator unit 21. These individual electrodes 35 are somewhat smaller than the liquid pressing chambers 10, and have a shape substantially similar to that of the liquid pressing chambers 10. Thus, these individual electrodes 35 are arranged to be held within regions in the upper surface of the piezoelectric actuator unit 21 which are opposed to the liquid pressing chambers 10.

A large number of liquid discharge pores 8 are formed in a liquid discharge surface on the lower surface of the passage member 4. These liquid discharge pores 8 are arranged at locations other than the region opposing to the sub manifolds 5*a* arranged on the lower surface of the passage member 4.

These liquid discharge pores 8 are also arranged in regions in the lower surface of the passage member 4 which are opposed to the piezoelectric actuator units 21. These liquid discharge pores 8 occupy, as a group, a region having substantially the same size and shape as the piezoelectric actuator units 21. The liquid drops can be discharged from the liquid discharge pores 8 by displacing the displacement element 50 of the corresponding piezoelectric actuator unit 21. The arrangement of the liquid discharge pores 8 is described later in detail. The liquid discharge pores 8 in their respective regions are arranged at equal intervals along a plurality of straight lines 15*a* to 15*d* parallel to the longitudinal direction of the passage member 4.

The passage member 4 included in the liquid discharge head body 13 has a laminate structure having a plurality of plates laminated one upon another. These plates are a cavity plate 22, a base plate 23, an aperture plate 24, supply plates 25 and 26, manifold plates 27, 28 and 29, a cover plate 30, and a nozzle plate 31 in descending order from the upper surface of the passage member 4. A large number of holes are formed in these plates. These plates are aligned and laminated so that these holes are communicated with each other to constitute the individual passages 32 and the sub manifolds 5*a*. As shown in FIG. 5, in the head body 13, the liquid pressing chamber 10 is disposed in the upper surface of the passage member 4, the sub manifolds 5*a* are disposed closer to the lower surface of the inside the passage member 4, and the liquid discharge pores 8 are disposed in the lower surface thereof. Thus, the components of the individual passage 32 are disposed close to each other at different positions, and the sub manifolds 5*a* and the liquid discharge pores 8 are connected to each other through the liquid pressing chambers 10.

The holes formed in these plates are described below. These holes can be classified as follows. Firstly, there are the liquid pressing chambers 10 formed in the cavity plate 22. Secondly, there is a communication hole constituting passages connected from one end of each of the liquid pressing chambers 10 to the sub manifolds 5*a*. This communication hole is formed in each of the plates in the range from the base plate 23 (specifically, inlets of the liquid pressing chambers 10) to the supply plate 25 (specifically, outlets of the sub manifolds 5*a*). This communication hole includes the apertures 12 formed in the aperture plate 24, and individual supply passages 6 formed in the supply plates 25 and 26.

Thirdly, there is a communication hole constituting paths communicated from the other end of each of the liquid pressing chambers 10 to the liquid discharge pores 8. This communication hole is referred to as a descender (partial passage) in the following description. The descender is formed in each of the plates in the range from the base plate 23 (specifically, outlets of the liquid pressing chambers 10) to the nozzle plate 31 (specifically, the liquid discharge pores 8).

Fourthly, there is a communication hole constituting the sub manifolds 5*a*. This communication hole is formed in the manifold plates 27 to 29.

These communication holes are connected to each other to form the individual passages 32 extending from the inlets of the liquid from the sub manifolds 5*a* (the outlets of the sub manifolds 5*a*) to the liquid discharge pores 8. The liquid supplied to the sub manifold 5*a* is discharged from the liquid discharge pore 8 through the following route. Firstly, the liquid proceeds upward from the sub manifold 5*a*, and passes through the individual supply passage 6 and reaches one end of the aperture 12. The liquid then proceeds horizontally along the extending direction of the aperture 12 and reaches the other end of the aperture 12. Subsequently, the liquid proceeds upward from there and reaches one end of the liquid pressing chamber 10. Further, the liquid proceeds horizontally along the extending direction of the liquid pressing chamber 10 and reaches the other end of the liquid pressing chamber 10. The liquid then mainly proceeds downward while gradually moving horizontally from there, and proceeds to the liquid discharge pore 8 opened in the lower surface.

The piezoelectric actuator unit 21 has a laminate structure made up of two piezoelectric ceramic layers 21*a* and 21*b*, as shown in FIG. 5. Each of these piezoelectric ceramic layers 21*a* and 21*b* has a thickness of approximately 20 μm. The entire thickness of the piezoelectric actuator unit 21 is approximately 40 μm. Both the piezoelectric ceramic layers 21*a* and 21*b* extend across the plurality of liquid pressing chambers 10 (refer to FIG. 3). These piezoelectric ceramic layers 21*a* and 21*b* are composed of ferroelectric lead zirconate titanate (PZT) based ceramic material having strong dielectric properties.

Each of the piezoelectric actuator units 21 includes a common electrode 34 composed of Ag—Pd based metal material or the like, and the individual electrode 35 composed of Au based metal material or the like. As described earlier, the individual electrode 35 is disposed at the location opposing to the liquid pressing chamber 10 in the upper surface of the piezoelectric actuator unit 21. One end of the individual electrode 35 is drawn beyond the region opposing to the liquid pressing chamber 10, thereby forming a connection electrode 36. The connection electrode 36 is composed of, for example, silver paradigm containing glass frit, and is formed in a convex shape with a thickness of approximately 15 μm. The connection electrode 36 is electrically connected to an electrode installed in a signal transmission section. A driving signal is transmitted from the control section 100 to the individual electrode 35 via the signal transmission section. This is described in detail later. The driving signal is applied on a fixed cycle in synchronization with a transport speed of the printing medium P.

Although the transmission of the driving signal is described later, a sequence of driving signals with a latch signal generated every Tc seconds (for example, a cycle of approximately 10-100 kHz) as a starting point are transmitted to all the liquid discharge heads 2. The driving signals for discharge or non-discharge are transmitted so that liquid drops are discharged concurrently from a single liquid discharge pore row parallel in the longitudinal direction. The driving signals for discharge or non-discharge are transmitted every Tc seconds to each of the liquid discharge pore rows.

The common electrode 34 is formed over substantially the entire surface in a planar direction in a region between the piezoelectric ceramic layer 21*a* and the piezoelectric ceramic layer 21*b*. That is, the common electrode 34 extends to cover all the liquid pressing chambers 10 in the region opposing to the piezoelectric actuator units 21. The thickness of the common electrode 34 is approximately 2 μm. The common electrode 34 is grounded in an unshown region, and is held at ground potential. In the present embodiment, a surface electrode (not shown) different from the individual electrodes 35 is formed at a position that is kept away from an electrode group made up of the individual electrodes 35 on the piezoelectric ceramic layer 21*b*. The surface electrode is electrically connected to the common electrode 34 via a through hole formed inside the piezoelectric ceramic layer 21*b*, and is connected to another electrode on the signal transmission section similarly to the large number of individual electrodes 35.

The common electrode 34 and the individual electrode 35 are arranged to hold therebetween only the piezoelectric ceramic layer 21*b* that is the uppermost layer, as shown in FIG. 5. The region held between the individual electrode 35 and the common electrode 34 in the piezoelectric ceramic layer 21*b* is referred to as an active area, and piezoelectric ceramics of the area is polarized. In the piezoelectric actuator units 21 of the present embodiment, only the uppermost piezoelectric ceramic layer 21*b* includes the active area, whereas the piezoelectric ceramic layer 21*a* does not include the active area and acts as a diaphragm. This piezoelectric actuator unit 21 has a so-called unimolf type configuration.

As described later, a predetermined driving signal is selectively applied to the individual electrode 35, thereby applying pressure to the liquid in the liquid pressing chamber 10 corresponding to this individual electrode 35. Consequently, the liquid drops are discharged from the corresponding liquid discharge pore 8 through the individual passage 32. That is, the part of the piezoelectric actuator unit 21 which is opposed to the liquid pressing chamber 10 corresponds to the individual displacement element 50 (actuator) corresponding to the liquid pressing chamber 10 and the liquid discharge pore 8. Specifically, the displacement element 50 whose unit structure is the structure as shown in FIG. 5 is fabricated into a laminate body made up of these two piezoelectric ceramic layers in each of liquid pressing chambers 10 by using the diaphragm 21*a*, the common electrode 34, the piezoelectric ceramic layer 21*b* and the individual electrode 35, which are located immediately above the liquid pressing chamber 10. The piezoelectric actuator unit 21 includes the plurality of displacement elements 50 as the pressing section. In the present embodiment, the amount of the liquid discharged from the liquid discharge pore 8 by a single discharge operation is approximately 5-7 pl (pico litter).

The large number of individual electrodes 35 are individually electrically connected to the control section 100 via the signal transmission section and wiring so that their respective potentials can be controlled individually.

In the piezoelectric actuator units 21 in the present embodiment, when an electric field is applied to the piezoelectric ceramic layer 21*b* in the polarization direction thereof by setting the individual electrodes 35 at a potential different from that of the common electrode 34, an area to which the electric field is applied acts as an active area that is distorted due to piezoelectric effect. At this time, the piezoelectric ceramic layer 21*b* expands or contracts in the thickness direction thereof, namely the stacking direction thereof, and tends to contract or expand in a direction orthogonal to the stacking direction, namely, the planar direction by transverse piezoelectric effect. On the other hand, the rest piezoelectric ceramic layer 21*a* is a non-active layer that does not include the region held between the individual electrode 35 and the common electrode 34, and therefore does not deform spontaneously. That is, the piezoelectric actuator unit 21 has a so-called unimolf type configuration in which the piezoelectric ceramic layer 21*b* on the upper side (namely, the side away from the liquid pressing chamber 10) is a layer including the active area, and the piezoelectric ceramic layer 21*a* on the lower side (namely, the side close to the liquid pressing chamber 10) is a non-active layer.

When in this configuration, the individual electrode 35 is set to a positive or negative predetermined potential with respect to the common electrode 34 by the control section 100 so that the electric field and the polarization are oriented in the same direction, the area (active area) held between the electrodes of the piezoelectric ceramic layer 21*b* contracts in the planar direction. On the other hand, the piezoelectric ceramic layer 21*a* as the non-active layer is not affected by the electric field, and therefore does not contract spontaneously but tends to restrict the deformation of the active area. This causes a difference in distortion in the planarization direction between the piezoelectric ceramic layer 21*b* and the piezoelectric ceramic layer 21*a*, and the piezoelectric ceramic layer 21*b* is deformed to project toward the liquid pressing chamber 10 (unimolf deformation).

According to the actual driving procedure in the present embodiment, the individual electrode 35 is previously set at a first voltage V1 V (volt, which may be omitted in the following) to obtain a higher potential than the common electrode 34, and the individual electrode 35 and the common electrode 34 are temporarily set at a low potential, for example, at the same potential by applying a second voltage lower than the first voltage V1 every time a discharge request is made, and thereafter the individual electrode 35 is again set at the high potential at a predetermined timing. This allows the piezoelectric ceramic layers 21*a* and 21*b* to return to their original shape at the timing that the individual electrode 35 has the low potential, and the volume of the liquid pressing chamber 10 is increased compared to its initial state (the state in which the potentials of both electrodes are different from each other). At this time, a negative pressure is applied to the inside of the liquid pressing chamber 10, and the liquid is absorbed from the manifold 5 into the liquid pressing chamber 10. Thereafter, at the timing that the individual electrode 35 is again set at the high potential, the piezoelectric ceramic layers 21*a* and

21*b* are deformed to project toward the liquid pressing chamber 10. Then, the pressure inside the liquid pressing chamber 10 become a positive pressure due to the reduced volume of the liquid pressing chamber 10, so that the pressure applied to the liquid is increased to deliver the liquid drops. That is, the driving signal containing pulses using the high potential as a datum is supplied to the individual electrode 35 for the purpose of discharging the liquid drops. An ideal pulse width is AL (acoustic length) that is the length of time during which a pressure wave propagates from the manifold 5 to the liquid discharge pore 8 in the liquid pressing chamber 10. Thereby, when a negative pressure state in the liquid pressing chamber 10 is reversed into a positive pressure state, both pressures are combined together, thus allowing the liquid drops to be discharged under a stronger pressure.

In gradation printing, a gradation expression is carried out by the amount (volume) of liquid drops adjusted by the number of liquid drops continuously discharged from the liquid discharge pore 8, namely, the number of deliveries of liquid drops. Therefore, the number of deliveries of liquid drops corresponding to a designated gradation expression are carried out continuously from the liquid discharge pores 8 corresponding to a designated dot region. When the liquid discharge is carried out continuously, it is generally preferable that the intervals between pulses supplied for discharging liquid drops be set at the AL. Thereby, the cycle of a residual pressure wave of the pressure generated when previously discharged liquid drops are discharged coincides with the cycle of a pressure wave of the pressure generated when liquid drops discharged later are discharged, and these two pressure waves are superimposed to amplify the pressure for discharging the liquid drops. In this case, the speed of the liquid drops discharged later seems to be increased, however, this is preferred because landing points of a plurality of liquid drops become close to each other.

Additionally, after the above driving signal is applied, a cancel signal may be applied to reduce residual vibrations remaining in the liquid in the individual passages 32.

In the case of printing using the foregoing liquid discharge heads 2, because the liquid discharge pores 8 are distributed in two dimension in a liquid discharge pore opening surface 4*a*, satisfactory recording cannot be obtained unless discharge timing is changed when the shape of a recording medium, the resolution of the sub scanning direction or the like are changed.

In order to simplify the explanation given below, a description is given of the fact that the liquid discharge heads with the arrangement of the liquid discharge pores 108 shown in FIG. 6(*a*) require change of discharge timing. The liquid discharge pores 108 are opened in the liquid discharge pore opening surface 104*a*, and are arranged to have a two-dimensional spread and to be long in one direction. The liquid discharge pores 108 are arranged on straight lines L1 to L4 that are the four liquid discharge pore rows, and are arranged at equal spatial intervals to each other on the straight lines L1 to L4. The intervals of the straight lines L1 to L4 are represented by p (mm, hereinafter the unit is omitted in some cases), and are identical to each other. These are not necessarily required. The liquid discharge pores 108 are arranged in the longitudinal direction at equal intervals d (mm, hereinafter the unit is omitted in some cases), thus allowing all the liquid discharge pores 108 to perform printing at the equal intervals d. Here, the liquid drops discharged from the liquid discharge pores 108 on their respective straight lines are configured to have the same discharge speed within the range of manufacturing variations.

The process of printing on a flat surface-shaped recording medium P1 by using the foregoing liquid discharge heads is described with reference to FIGS. 7(*a*-1) to 7(*a*-4). In this liquid discharge head, the discharge timing is adjusted to achieve satisfactory printing onto the flat-surface-shaped recording medium P1. Here, a 1-pixel wide line parallel to the longitudinal direction is printed. The arrows in these figures denote the transport direction of the recording medium P1. Ha (mm, hereinafter the unit is omitted in some cases) denotes a distance between the liquid discharge pore opening surface 104*a* and the recording medium P1. L1 to L4 are all the same. The distance is here a flight distance of a liquid drop, specifically because the liquid drop is discharged in a direction orthogonal to the liquid discharge pore opening surface 104*a*, and is the flight distance of the liquid drop which is discharged from the liquid discharge pore opening surface 104*a* in the orthogonal direction and lands on the recording medium P1. When the flight direction is not the orthogonal direction, the distance is a flight distance of the liquid drop which is discharged toward the orthogonal direction and lands on the recording medium P1. The flight direction corresponds to a direction of a nozzle connected to the liquid discharge pore 108.

In FIG. 7(*a*-1), the recording medium P1 is transported to a predetermined position and thus a liquid drop Da1 is discharged from the liquid discharge pore 108 on the straight line L1. The liquid drop A flies in the direction orthogonal to the liquid discharge pore opening surface 104*a*, that is, the direction of the nozzle connected to the liquid discharge pore 108.

In FIG. 7(*a*-2), a liquid drop Da2 from the liquid discharge pore 108 on the straight line L2, a liquid drop Da3 from the liquid discharge pore 108 on the straight line L3, and a liquid drop Da4 from the liquid discharge pore 108 on the straight line L4 are sequentially discharged and fly, and then these liquid drops A land on the recording medium P1.

In FIG. 7(*a*-3), a liquid drop Da2 lands on the straight line on the recording medium P1 on which a liquid drop Da1 lands. In the figure, though the liquid drop Da1 and the liquid drop Da2 are overlapped with each other, these two drops actually land at positions dislocated toward the nearside and farside in the figure.

In FIG. 7(*a*-4), similarly, liquid drops Da3 and Da4 land on the straight line on the recording medium P1 on which liquid drops Da1 and Da2 land, thereby printing a single straight line. In other words, the liquid drops are discharged from the liquid discharge pores 108 on the straight lines L1 to L4 at different timings so as to be printed into the single straight line.

FIGS. 7(*b*-1) to 7(*b*-4) show that similar printing is performed on a concave-surface shaped recording medium P2. In this case, a flight direction of a liquid drop from L1 is a direction toward the center of the drum along which the recording medium P2 is transported. A distance from the liquid discharge pore opening surface 104*a* to the recording medium P2 is the shortest, and the distance thereof is Hb1 (mm, hereinafter the unit is omitted in some cases). A flight distance from L4 is the longest, and the distance thereof is Hb4 (mm, hereinafter the unit is omitted in some cases).

In this case, a liquid drop Db1 from the liquid discharge pore 108 on the straight line L1, a liquid drop Db2 from the liquid discharge pore 108 on the straight line L2, a liquid drop Db3 from the liquid discharge pore 108 on the straight line L3, and a liquid drop Db4 from the liquid discharge pore 108 on the straight line L4 are sequentially discharged. The discharge timings thereof are similar to those in FIGS. 7(*a*-1) to 7(*a*-4).

In FIG. 7(*b*-3), the liquid drop Db2 may fly to such a position at which it could have landed if the recording medium P2 has a flat surface shape, however, because the recording medium P2 has the concave-surface shape, its flight distance is long, and does not yet land thereon. Thereafter, the recording medium P2 is transported until the liquid drop Db2 lands thereon, and the landing position thereof is accordingly displaced. This is also true for the liquid drops Db3 and Db4, and their respective landing positions are dislocated as shown in FIG. 7(*b*-4).

Thus, the discharge performed at the same discharge timing with respect to the recording media of different shapes may deteriorate the accuracy of landing position.

Figure 6:
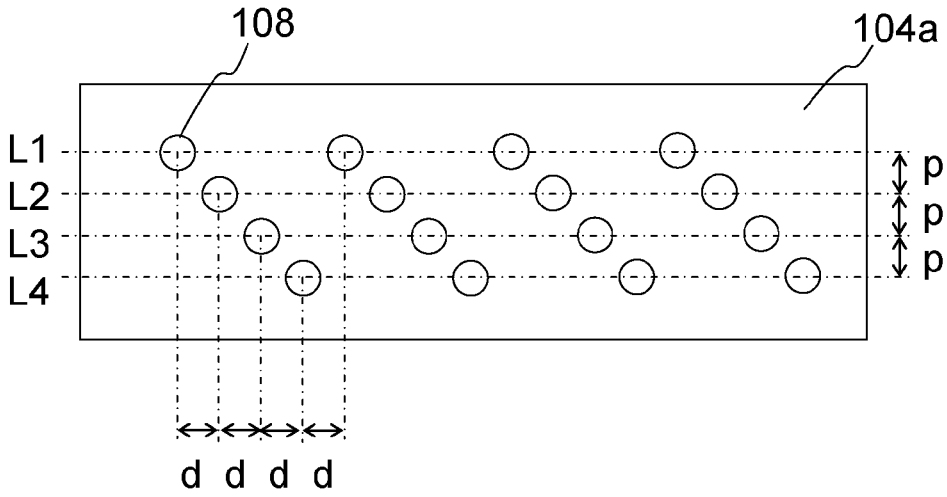
FIG. 6(*a*) is a schematic diagram showing an arrangement state of liquid discharge pores for the purpose of explaining printing operations.
Figure 6:
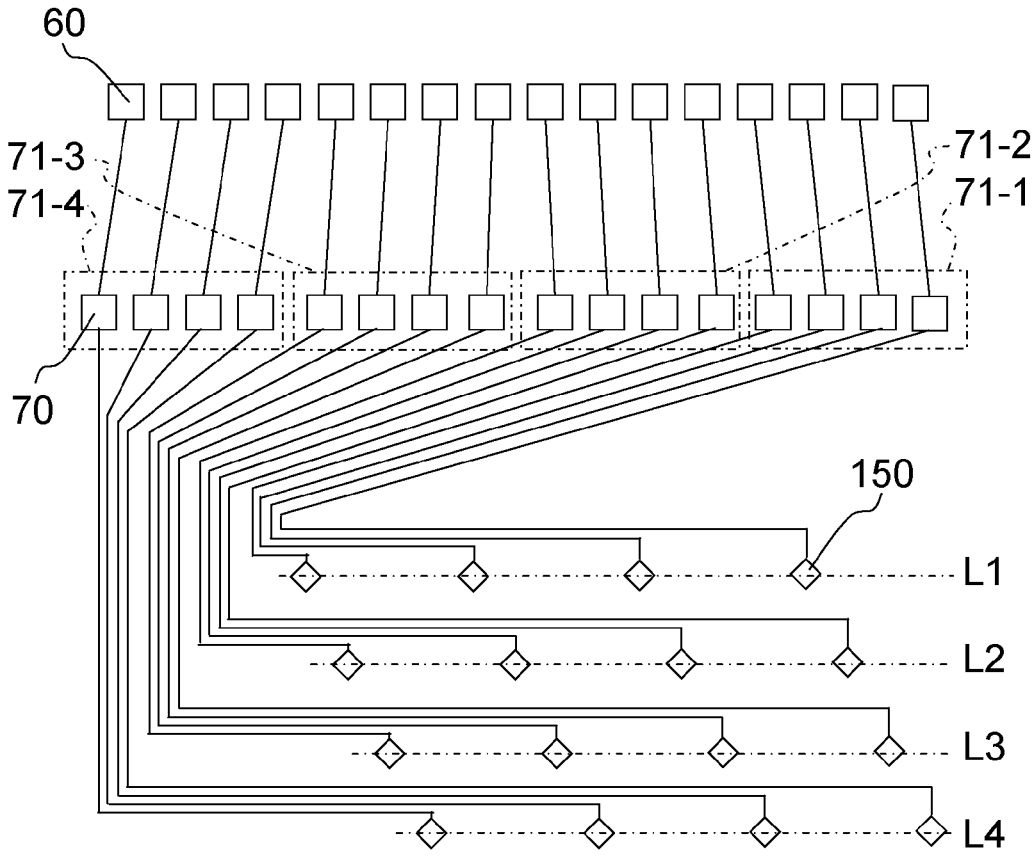

Therefore, the present invention is configured to permit liquid discharge at optional discharge timings from the liquid discharge pore rows L1 to L4 by incorporating the driving device as shown in FIG. 6(*b*) into the control section 100. FIG. 6(*b*) shows schematically the connection relationship among first latch circuits 60, second latch circuits 70 and displacement elements 150. The arrangement of the displacement elements 150 correspond to the arrangement of the liquid discharge pores 108 in FIG. 6(*a*). Although an unshown driving signal transmission circuit actually drives these displacement elements 150 on the basis of the value held in the second latch circuit 70, the illustration thereof is omitted for schematic illustration.

Figure 8:
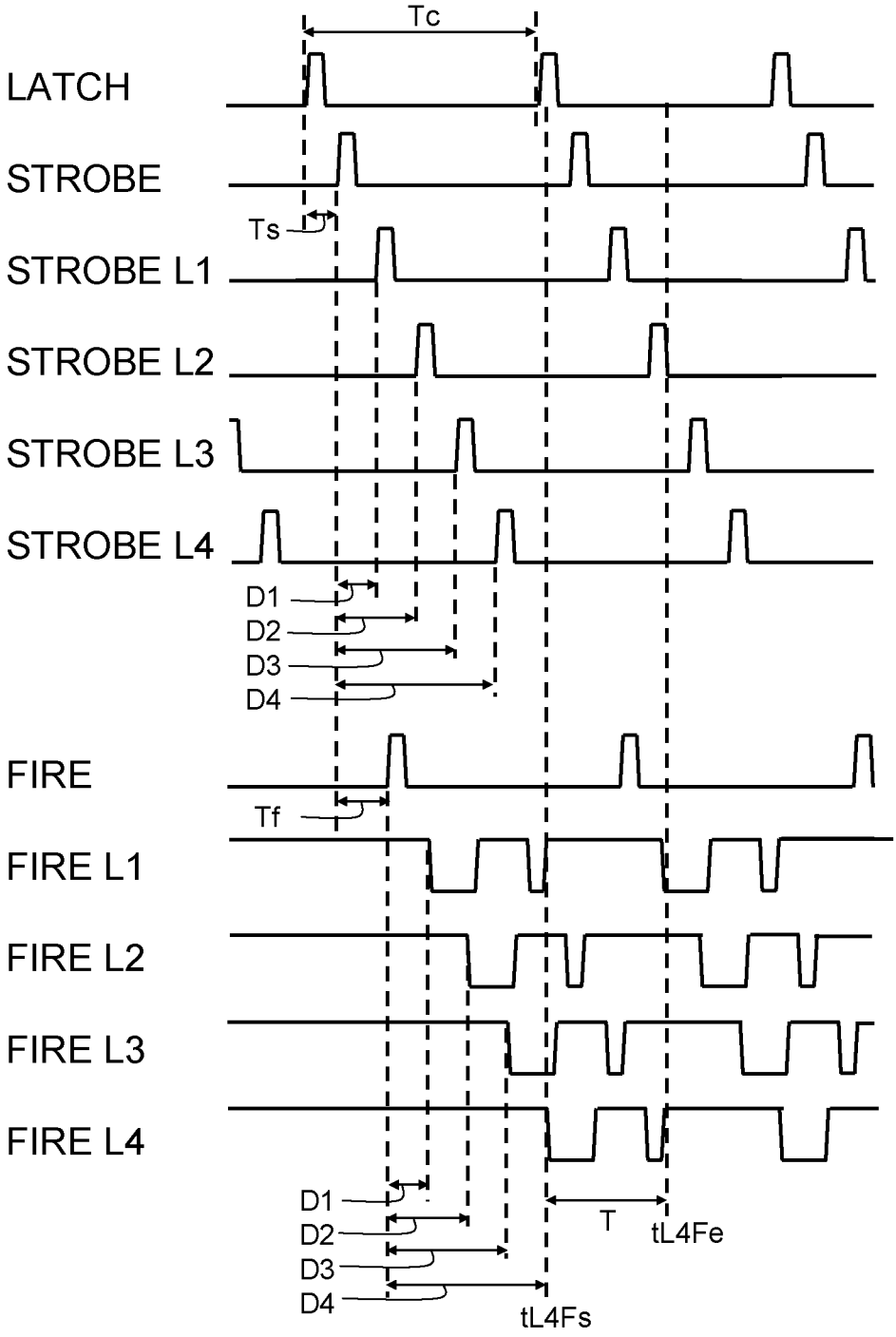
FIG. 8 is a timing chart of operations of the driving device for driving the liquid discharge heads shown in FIG. 6(*b*)

FIG. 8 is the timing chart of the driving device. A latch signal (LATCH), strobe signals (STROBE, STROBEs L1 to L4), and a fire signal (FIRE) are signals inside the control section 100, and these signals may be generated by a circuit inside the driving device or a circuit other than the driving device in the control section 100. Driving signals (FIREs L1 to L4) are signals transmitted from the driving device to the displacement elements 150. The displacement elements 150 and the second latch circuits 71 corresponding to virtual straight lines L1 to L4 are respectively operated at the same timing. That is, the displacement element 150 corresponding to the virtual straight line L1 is driven by the FIRE L1, and the second latch circuit 71-1 is latched by the STROBE L1. Since the FIRE L1 becomes a driving signal corresponding to the data held by the second latch circuit 71-1, and therefore the driving signals are transmitted at the same timing, but the driving signals are not identical to each other. The length of the driving signals is approximately 5 ms to 50 ms. On the other hand, the latch signal, strobe signals and fire signal usually have a pulse width of approximately μsec order, but the pulse width is emphasized in FIG. 8.

For the sake of simplicity, FIG. 6(*b*) illustrates an example where four second latch circuit groups 71 are arranged to permit discharge from the liquid discharge pores 108 shown in FIG. 6(*a*). In order to drive a single piezoelectric actuator unit 21 of the liquid discharge head 2 shown in FIGS. 2 to 5, 16 second latch circuit groups are required to similarly drive 16 rows of liquid discharge pore rows 15*a*, 15*b*, 15*c* and 15*d* located correspondingly to the single piezoelectric actuator unit 21. Further, in order to drive the liquid discharge head 2 shown in FIGS. 2 to 5, 16 second latch circuit groups are required for each of the staggered piezoelectric actuator units 21. Accordingly, a total of 32 second latch circuit groups are required.

The driving device can be miniaturized by configuring it as an IC on a semiconductor. It is preferable to use four ICs corresponding to the four piezoelectric actuator units 21 in terms of cost reduction. In this case, each IC includes 16 second latch circuit groups. Also in this case, one end of a line printed by a single piezoelectric actuator unit 21 is overlapped with a line printed by the adjacent piezoelectric actuator unit 21. Therefore, though the end of the line printed by the single piezoelectric actuator unit 21 is discontinuous, this line is also included in the amount of a single line of the present invention.

The driving device shown in FIG. 6(*b*) includes 16 first latch circuits 60. The number thereof is equal to the number of the liquid discharge pores 108 of the liquid discharge head shown in FIG. 6(*a*), and is also the number of pixels of a printable line in the longitudinal direction of the liquid discharge head. Upon receipt of the latch signal (LATCH) generated by the first latch circuit 60 or the control section 100, pixel data are latched from an unshown external circuit. Retained pixel data may be binary data indicating whether the pixels are printed or not, or multivalued data indicating pixel densities.

The first latch circuits 60 can retain one-line pixel data as a whole. In the actual use situation, however, the data of the single line of a printed image are not necessarily retained. The actually retained data is pixel data to be discharged at the next discharge timing. For example, pixel data of the 20th line from one end of the image are retained in the first latch circuit 60 corresponding to the virtual straight line L1, pixel data of the 16th line from the one end of the image are retained in the first latch circuit 60 corresponding to the virtual straight line L2, pixel data of the 12th line from the one end of the image are retained in the first latch circuit 60 corresponding to the virtual straight line L3, and pixel data of the 8th line from the one end of the image are retained in the first latch circuit 60 corresponding to the virtual straight line L4. The control section 100 prepares pixel data latched by the first latch circuits 60 in order to allow them to retain the pixel data of appropriate lines as described above.

Those corresponding to the pixel data are recorded in driving signal transmission circuit. For example, the pixel data are the binary data indicating whether the pixels are printed or not, a discharge driving signal for printing the pixels or a non-discharge driving signal for not printing the pixels is transmitted. The discharge driving signal is a driving signal of, for example, pull-strike as described above. The non-discharge driving signal may be a signal for merely unchanging voltage or a signal for non-discharging the liquid and reducing crosstalk and residual variations in the passage. When the pixel data are the multivalued data indicating the pixel densities, driving signals having different discharge amounts and different numbers of discharged liquid drops are transmitted depending on the value of the pixel data. Among these driving signals, one having the longest time is referred to as T (second, hereinafter the unit is omitted in some cases).

Those indicated by FIREs L1 TO L4 in FIG. 8 are all the discharge driving signals, and the discharge driving signals of T seconds in total in which a cancel pulse is transmitted after a main pulse having a width of AL. When gradation expression is carried out, as the longest discharge driving signal, a driving signal including a plurality of main pulses, such as a driving signal in which the cancel pulse follows three main pulses, are used in some cases. Thus, the driving signal that thus becomes long is susceptible to a phenomenon where when the delay is changed, the transmission of the driving signal is not completed before the next latch signal. The present invention is particularly useful in this phenomenon.

The latch signal is generated in a cycle of T seconds or more. The cycle is taken here to be Tc seconds. The strobe signal is generated after Ts seconds from the latch signal, where Ts is less than Tc. The driving device also retains delay times D1 to D4 seconds with respect to the second latch circuits 70, respectively. These values are changeable when changing the printing conditions.

The strobe L1 signal is generated after Ts+D1 seconds from the latch signal, where Ts is predetermined value. By this signal, the second latch circuit 70 included in the second latch circuit group 71-1 corresponding to the virtual straight line L1 latch the pixel data of the first latch circuits 60 respectively connected to the second latch circuits 70. Thereafter in the same manner, by the strobe L2 to L4 signals, the second latch circuit groups 71-2 to 71-4 corresponding to the virtual straight lines L2 to L4 latch the pixel data of the first latch circuits 60 respectively connected to the second latch circuits 70, after Ts+D2 seconds, after Ts+D3 seconds, and after Ts+D4 seconds. At this time, a maximum elapsed time from the latch signal is Tc seconds or less. That is, when D4 is the maximum, Ts+D4<Tc. A shorter Ts is preferable for setting a longer D4.

Subsequently, the FIRE signal is generated after Tf seconds from the strobe signal, where Tf is a predetermined value. Here, Ts+Tf<Tc, and Tf+T<Tc.

After the delay time D1 seconds are passed from the FIRE signal, namely, after Ts+Tf+D1 seconds are passed from the latch signal, the driving signal L1 (FIRE L1) is transmitted to the displacement elements 150 corresponding to the virtual straight line L1 on the basis of the pixel data retained in the second latch circuits 70 belonging to the second latch circuit group 71-1. The driving signal L1 is transmitted for a period of the longest T seconds. During this period, the pixel data retained in the second latch circuits 70 belonging to the second latch circuit group 71-1 remain unchanged. That is, the driving signal L1 is transmitted in its normal state because the second latch circuits 70 belonging to the second latch circuit group 71-1 do not latch the pixel data of the first latch circuits 60 by the strobe L1 signal.

Subsequently, after delay times D1, D3 and D4 seconds are passed from the FIRE signal, namely, after Ts+Tf+D2 seconds, Ts+Tf+D3 seconds, and Ts+Tf+D4 seconds are respectively passed from the latch signal, the driving signals L2 to L4 (FIREs L2 to L4) are transmitted to the displacement elements 150 corresponding to the virtual straight lines L2 to L4 on the basis of the pixel data retained in the second latch circuits 70 belonging to the second latch circuit groups 71-2 to 71-4.

The above configuration eliminates the possibility that the strobe L4 signal is transmitted during the period of transmission of the driving signal L4 (FIRE 4) having the longest delay time, namely during a period of time from tL4Fs to tL4Fe. That is, the driving signal L4 is transmitted in its normal state because the second latch circuits 70 belonging to the second latch circuit group 71-4 do not latch the pixel data of the first latch circuits 60 by the strobe L4 signal. If an attempt is made to directly transmit the driving signal L4 on the basis of the pixel data of the first latch circuits 60, a latch signal next to the latch signal, by which the pixel data has been latched, is already generated in the first latch circuits 60. Therefore, the data retained in the first latch circuits 60 can be changed, failing to be a driving signal on the basis of appropriate pixel data.

The foregoing driving method can be explained in a different way as follows. By the latch signal generated every Tc seconds, the pixel data are latched into the first latch circuit 60. After delay time Ts+D1, Ts+D2, Ts+D3, and Ts+D4 are respectively passed from the latch signal, the second latch circuits 70 belonging to the second latch circuit groups 72-1 to 71-4 latch the pixel data retained in the first latch circuits. After a predetermined time Tf seconds or less and the delay time Ts+D1, Ts+D2, Ts+D3, and Ts+D4 are respectively passed from the latch signal, the driving signals are transmitted on the basis of the pixel data retained in the second latch circuits 70 belonging to the second latch circuit groups 72 to 72-4, respectively. The specifically described STROBEs L1 to L4 and the like are used in one method for causing this operation. As long as this operation can be performed, the internal operation may be performed by other method.

Although the case of D1<D2<D3<D4 has been illustrated in the foregoing description, without limitation thereto, D1 to D4 can be set at an optional value of Tc−Ts or less. When it is necessary to set a delay at a value exceeding Tc−Ts, the pixel data latched by the first latch circuits 60 may be staggered by adjusting the pixel data prepared by the control section 100. By this adjustment, except for a little time to perform the latch operation in the driving device, the discharge from the liquid discharge pores 108 belonging to the virtual straight lines L1 to L4, respectively, can be performed on a row basis at an optional timing.

The following printings are achievable by adjusting the delay times by using the foregoing driving device. That is, printing onto a recording medium having an optional diameter cylindrical shape or other concavo-convex shape is achievable. Further, printing at an optional resolution in the sub scanning direction is achievable. For example, printing of 600×360 dpi is achievable by using the liquid discharge heads designed for 600×600 dpi and having the liquid discharge pores arranged therefor.

The following printings are also achievable by additionally adjusting the arrangement of the liquid discharge pores. That is, by shifting the positions of the liquid discharge pores in the sub scanning direction and by accordingly changing the delays, the driving timing can be changed to stagger a period of time during which the adjacent liquid pressing chambers are pressed, thereby reducing crosstalk. When performing printing in which the liquid discharge heads are subject to reciprocating motion, displacement in landing positions occurs between the forward and backward movements, however, the displacement can be eliminated by changing the delay for the forward and backward movement.

When the discharge speed of liquid drops differs depending on the corresponding liquid discharge pore row in the piezoelectric actuator due to manufacturing variations, landing accuracy can be improved by adjusting the delay correspondingly to the speed.

Figure 9:
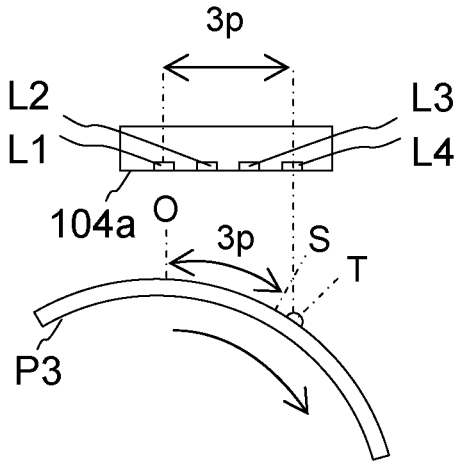
FIG. 9 is a longitudinal cross section of a state in the middle of printing.
Figure 10:
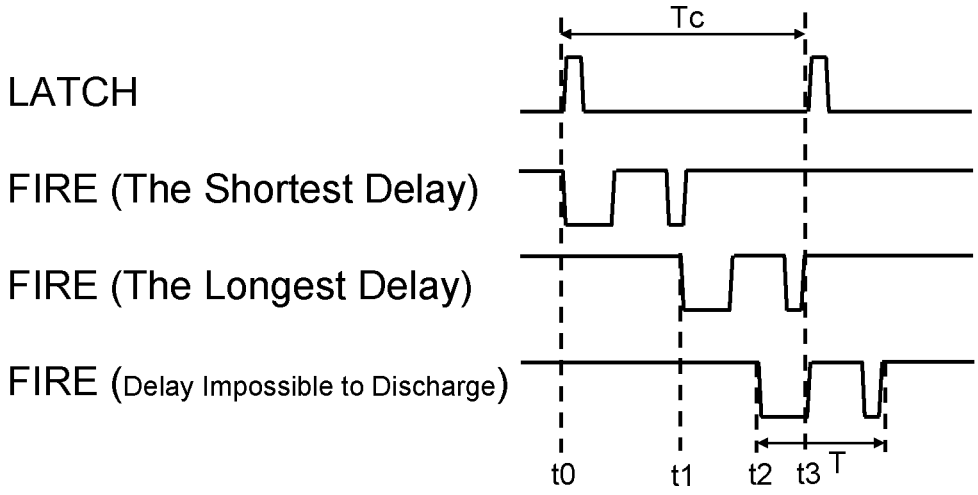
FIG. 10 is a timing chart showing problems of conventional operations.

With reference to FIG. 9, another reason for poor landing position accuracy is described. FIG. 8 shows the necessity of delay adjustment correspondingly to the increased flight distance. By adjusting the delay, the liquid drop lands at a position T in a direction orthogonal to the liquid discharge pore opening surface 104*a*, from the position of the straight line L4 which is separated from the straight line L1 by a distance 3*p* on the liquid discharge pore opening surface 104*a*. However, when the distance 3*p* is measured along a recording medium P3 from an upper point O located on a virtual line extending from the straight line L1 on the recording medium P3 in a direction orthogonal to the liquid discharge pore opening surface 104*a*, the distance 3*p* corresponds to a point S. Therefore, the landing position is displaced a distance ST. In order to further improve the landing accuracy, the timing of discharge from the liquid discharge pores 108 on the straight line L4 is required to be delayed for a period of time during which the recording medium P3 is transported over the distance ST.

That is, when the flight distance of the liquid is shorter, the landing positions are brought near each other by increasing the delay time set for each of the second latch circuit groups 71-1 to 71-4. The flight distance is a distance from the liquid discharge pores 108 of the liquid discharge pore rows L1 to L4 corresponding to the second latch circuit groups 71-1 to 71-4 to the recording medium on which a discharged liquid lands.

Additionally, it is preferable to consider deceleration of liquid drops during flight. The discharged liquid drop decelerated due to air resistance while flying. A smaller amount of liquid drop causes a sharper deceleration. That is, when different amounts of liquid drops are discharged for gradation expression or the like, displacement of landing positions occurs because the smaller liquid drops cause the sharper deceleration during flight even when their flight speeds are substantially the same at the point of discharge.

This displacement can be reduced by quickly transmitting the driving signals. This however requires designing a circuit configured to provide delays respectively to the liquid discharge pores 108. A driver IC including such a circuit is unsuitable because of larger scale circuit and higher costs, and because a higher heating value deteriorates characteristics of the liquid discharge heads.

Hence, a driving signal having a period of time during which there is initially no voltage change from a standby voltage (hereinafter referred to as initial standby time) (including the case of time zero) is prepared as a driving signal, and the discharge timings are staggered by changing initial standby time instead of providing delays to the liquid discharge pores 108, respectively. That is, as the driving signals transmitted to the driving section, the driving signals are transmitted at the same timing, but some of the driving signals are provided with the initial standby time, thus making it possible to stagger actual driving times.

That is, the influence of the deceleration differences of the liquid drops can be reduced by preparing a plurality of data of the driving signals according to the amount of discharged liquid drops, and by using the driving signal having a longer initial standby time continued until the initial voltage change occurs in the driving signals, as the amount of discharged liquid drops is increased.

Hereat, the amount of liquid drops denotes the liquid drops for forming a pixel. In the liquid discharge heads from which a plurality of liquid drops are discharged for gradation expression, the amount of liquid drops denotes the amount of liquid drops after being discharged and then integrated together during flight.

Figure 11:
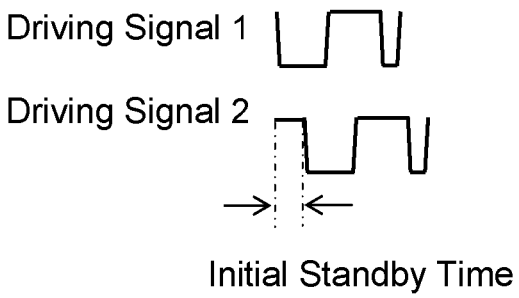
FIGS. 11(*a*) and 11(*b*) are schematic diagrams showing a driving method of other embodiment of the present invention.
Figure 11:
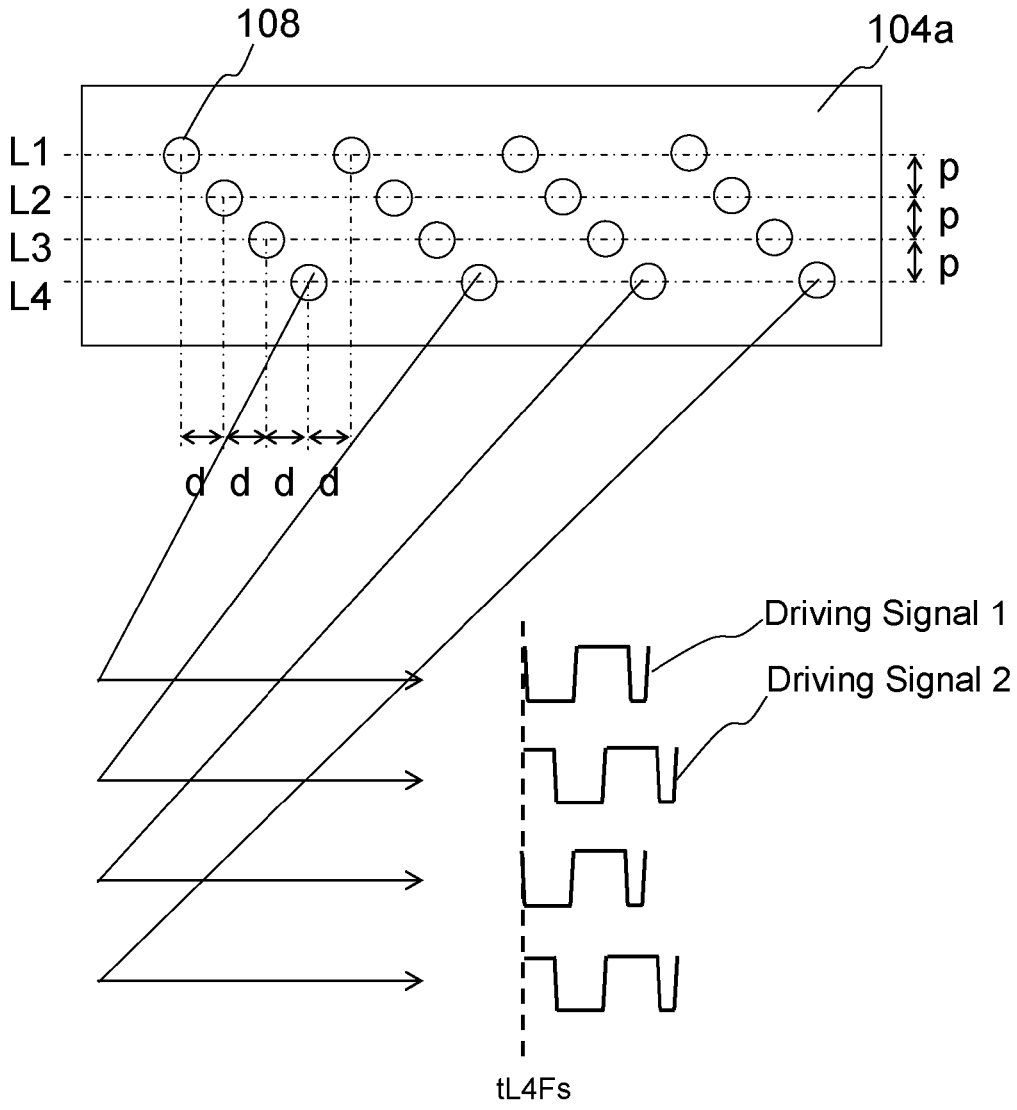

Furthermore, crosstalk can also be reduced by using a driving waveform including the above-mentioned initial standby time. This is described with reference to FIG. 11. The liquid pressing chambers 10 connected to the liquid discharge pore rows L1 to L4 are arranged to be adjacent each other via rhombic corner portions thereof, and are less susceptible to the influence of crosstalk than the liquid pressing chambers 10 adjacent to each other via rhombic side portions of the liquid pressing chambers 10. The crosstalk can be reduced by individually inserting a delay into them. This however enlarges the circuit scale as stated earlier. FIG. 11(*a*) shows the driving signals 1 and 2 having different initial standby times. The driving signal 1 is subjected to a voltage change from the beginning of the signal, and the driving signal is initially provided with the standby time. FIG. 11(*b*) shows that in the liquid discharge pores 108 included in the liquid discharge pore row L4, the driving signals having different initial standby times are respectively transmitted to the liquid discharge pores 108 adjacent to each other. Thus, the simple circuit configuration for concurrently transmitting the driving signals allows the actual driving start times to be staggered, thereby reducing crosstalk.

The foregoing can be described in another way as follows. The driving device includes a plurality of first latch circuits capable of retaining one-line pixel data, a plurality of second latch circuits respectively connected to the plurality of first latch circuits, and a driving waveform transmission circuit which retains a driving wave having a length of Tc seconds or less, and transmits the driving waveforms. The entirety of the plurality of second latch circuits is divided into a plurality of second latch circuit groups. The plurality of second latch circuit groups respectively include the plurality of second latch circuits. Delay times of Tc seconds or less are respectively set to the plurality of second latch circuit groups. The pixel data are latched into the plurality of first latch circuits by a latch signal generated every Tc seconds. After the delay time is passed from the latch signal, the pixel data retained in the first latch circuits are latched into the plurality of second latch circuits. After a total time of the delay time and a predetermined time of Tc seconds or less is passed from the latch signal, the driving waveform is transmitted on the basis of the pixel data retained in the plurality of second latch circuits.

The liquid discharge head includes a liquid discharge pore opening surface having a plurality of liquid discharge pores for discharging liquid drops opened therein, a plurality of driving sections for allowing the plurality of liquid discharge pores to deliver liquid, and a driving device for driving the liquid discharge head as set forth in claim 1 which respectively drives the plurality of driving sections on the basis of the pixel data retained in the second latch circuits. The plurality of liquid discharge pores constitute a plurality of linear liquid discharge pore rows parallel to each other, and are arranged at equal intervals in one direction so as not to be overlapped with each other in a direction orthogonal to the one direction. The driving sections for allowing the liquid discharge pores included in one of the liquid discharge pore rows to deliver the liquid are respectively driven on the basis of the pixel data retained in the second latch circuits included in one of the second latch circuit groups.

The recording device includes the liquid discharge head and a transport section for transporting a recording medium relatively to the liquid discharge head.

The driving device of the present invention includes a first latch circuit, a second latch circuit and a driving signal transmission circuit. The driving device is operated by allowing a control signal generation circuit to transmit a latch signal to the first latch circuit, a strobe signal to the second latch circuit, and a fire signal to the driving signal transmission circuit. The driving device is configured to transmit latch signal, strobe signal and fire signal at set intervals, and transmit these signals by adding a delay thereto.

The foregoing liquid discharge head 2 is manufactured, for example, in the following manner.

With a general tape forming method such as roll coater method or slit coater method, a tape composed of piezoelectric ceramic powder and an organic composition is formed and fired, thereby manufacturing a plurality of green sheets serving as the piezoelectric ceramic layers 21*a* and 21*b*. An electrode paste serving as the common electrode 34 is formed on the surface of a part of each of these green sheets by printing method or the like. Via holes are formed in a part of these green sheets, and the inside of these via-holes is filled with via-conductor as needed.

Then, these green sheets are laminated one upon another to manufacture a laminate, and the laminate is adhered with pressure. The laminate thus adhered with pressure is fired in a high oxygen concentration atmosphere, and the individual electrodes 35 are printed on the surface of the fired body by using an organic metal paste, followed by firing. Thereafter, the connection electrode 36 is printed by using Ag paste, followed by firing. Thus, the piezoelectric actuator unit 21 is manufactured.

Subsequently, the passage member 4 is manufactured by laminating plates 22 to 31, which are obtained by rolling method or the like, with an adhesive layer interposed therebetween. Holes in these plates 22 to 31, which serve as the manifolds 5, the individual supply passages 6, the liquid pressing chambers 10 and the descenders are processed into their respective predetermined shapes by etching.

These plates 22-31 are preferably formed by at least one kind of metal selected from the group consisting of Fe—Cr base, Fe—Ni base, and WC—TiC base metals. Particularly when ink is used as the liquid, these plates are preferably composed of a material having excellent corrosion resistance to the ink. Hence, the Fe—Cr base metals are more preferred.

The piezoelectric actuator unit 21 and the passage member 4 can be laminated and bonded together, for example, with an adhesive layer interposed therebetween. As the adhesive layer, a well-known one may be used. However, in order to avoid the influence on the piezoelectric actuator unit 21 and the passage member 4, it is preferable to use thermosetting resin adhesive of at least one kind selected from the group consisting of epoxy resin, phenol resin, and polyphenylene ether resin, each having a heat-cure temperature of 100-150° C. The piezoelectric actuator unit 21 and the passage member 4 can be heat-connected to each other by using the adhesive layer and by heating it up to the heat-cure temperature thereof.

Then, in order to electrically connect the piezoelectric actuator unit 21 and the control circuit 100, silver paste is supplied to the connection electrode 36, and an FPC that is a signal transmission section previously mounting the driver IC thereon is placed on the silver paste. The silver paste is cured for electrical connection by applying heat thereto. In mounting the driver IC, flip-chip electrical connection to the signal transmission section is achieved by soldering, and thereafter, protective resin is supplied around the solder, followed by curing.

DESCRIPTION OF REFERENCE NUMERALS

1 printer
2 liquid discharge head
4 passage member
4*a* liquid discharge pore opening surface
4*b* liquid pressing chamber surface
5 manifold
5*a* sub manifold
5*b* opening of manifold (liquid inlet pore)
5*c* liquid supply path
6 individual supply passage
8 liquid discharge pore
9 liquid pressing chamber group
10 liquid pressing chamber
11*a*, 11*b*, 11*c* and 11*d* liquid pressing chamber rows
12 aperture
13 liquid discharge head body
15*a*, 15*b*, 15*c* and 15*d* liquid discharge pore rows
21 piezoelectric actuator unit
21*a* piezoelectric ceramic layer (diaphragm)
21*b* piezoelectric ceramic layer
22-31 plates
32 individual passage
34 common electrode
35 individual electrode
36 connection electrode
50 displacement element (driving section)
60 first latch circuit
70 second latch circuit
71 second latch circuit group
71-1 second latch circuit groups corresponding to displacement elements on a virtual straight line L1
71-2 second latch circuit groups corresponding to displacement elements on a virtual straight line L2
71-3 second latch circuit groups corresponding to displacement elements on a virtual straight line L3
71-2 second latch circuit groups corresponding to displacement elements on a virtual straight line L4

What is claimed is:

1. A driving device for driving a liquid discharge head, comprising:

a latch signal generation circuit for generating a latch signal every Tc seconds, wherein Tc is an interval in which driving signals are transmitted;

a delay time retention circuit for retaining data of delay times of less than Tc seconds, wherein the delay time is a period of time after the latch signal has been transmitted;

a plurality of first latch circuits which are capable of retaining one-line pixel data, and latch the pixel data upon receiving the latch signal;

a plurality of second latch circuits which are divided into a plurality of second latch circuit groups, each second latch circuit group latching pixel data retained in corresponding first latch circuits after the delay time for the second latch circuit group has expired; and a driving signal transmission circuit which retains data of driving signals having a length of Tc seconds or less, and transmits the driving signals on a basis of the pixel data retained in the second latch circuits of one of the second latch circuit groups to a plurality of driving sections, after the delay time for the second latch circuit group has expired.

2. A recording apparatus, comprising:

a liquid discharge pore opening surface having a plurality of liquid discharge pores therein, in which the plurality of liquid discharge pores are arranged at equal intervals in one direction to constitute a plurality of linear liquid discharge pore rows parallel to each other, wherein the liquid discharge pores do not overlap with each other in a direction orthogonal to the one direction;

a plurality of driving sections for allowing the liquid discharge pores to discharge liquid;

a transport section for transporting a recording medium with respect to the liquid discharge pore opening surface;

a memory section for retaining pixel data constituting an image; and a control section comprising:

a latch signal generation circuit for generating a latch signal every Tc seconds, wherein Tc is an interval in which driving signals are transmitted, a delay time retention circuit for retaining data of delay times of less than Tc seconds, wherein the delay time is a period of time after the latch signal has been transmitted, a plurality of first latch circuits which are capable of retaining pixel data for the plurality of liquid discharge pores, wherein the first latch circuits latch pixel data from the memory section upon receiving the latch signal, a plurality of second latch circuits which are divided into a plurality of second latch circuit groups, each second latch circuit group latching pixel data retained in corresponding first latch circuits after the delay time for the second latch circuit has expired, and a driving signal transmission circuit which retains data of driving signals having a length of Tc seconds or less, and concurrently transmits the driving signals on a basis of the pixel data retained in the second latch circuits of one of the second latch circuit groups to the plurality of driving sections corresponding to one of the liquid discharge pore rows, after the delay time for the second latch circuit group has expired.

3. The recording apparatus according to claim 2, wherein the delay time for each of the second latch circuit groups becomes longer when a flight distance of liquid becomes shorter, wherein the flight distance is a distance from the liquid discharge pores to the recording medium on which a discharged liquid lands.

4. The recording apparatus according to claim 3, wherein the driving signal transmission circuit retains data of the plurality of driving signals depending on a liquid discharge amount and the flight distance, the data of the driving signals includes an initial standby time until an initial voltage change occurs in the driving signals, the initial standby time becoming longer with increasing the liquid discharge amount, and when a comparison is made between the data of the driving signals having different flight distances, as the flight distance becomes longer, there is a larger difference in the initial standby time of driving signals having different liquid discharge amounts.

5. The recording apparatus according to claim 2, wherein the driving signal transmission circuit retains data of the plurality of driving signals depending on a liquid discharge amount, and the data of the driving signals includes an initial standby time until an initial voltage change occurs in the driving signals, the initial standby time becoming longer with increasing the liquid discharge amount.

6. The recording apparatus according to claim 2, wherein the driving signal transmission circuit retains a plurality of data of the driving signals having different initial standby times until an initial voltage change occurs in the driving signals, and transmits the driving signals having the different initial standby times to the driving sections corresponding to the liquid discharge pores adjacent to each other in the liquid discharge pore row.

7. A recording method using a recording apparatus, the recording apparatus comprising a liquid discharge pore opening surface having a plurality of liquid discharge pores therein, in which the plurality of liquid discharge pores are arranged at equal intervals in one direction to constitute a plurality of linear liquid discharge pore rows parallel to each other, wherein the liquid discharge pores do not overlap with each other in a direction orthogonal to the one direction, a plurality of driving sections, and a control section comprising:

(i) a plurality of first latch circuits capable of retaining pixel data for the plurality of liquid discharge pores, (ii) a plurality of second latch circuits respectively connected to the plurality of first latch circuits, and (iii) a driving signal transmission circuit which retains data of driving signals having a length of Tc seconds or less, wherein Tc is an interval in which driving signals are transmitted, and transmits the driving signals to the plurality of driving sections, wherein the recording method is configured to deliver liquid to a recording medium transported relative to the liquid discharge pore opening surface, and the recording method comprises:

dividing the plurality of second latch circuits into a plurality of second latch circuit groups;

individually setting delay times of Tc seconds or less for each of the plurality of second latch circuit groups, wherein the delay time is a period of time after a latch signal has been transmitted;

generating the latch signal every Tc seconds;

latching pixel data into the plurality of first latch circuits;

latching the pixel data retained in the first latch circuits into the plurality of second latch circuits after the delay time for each of the second latch circuit groups has expired; and concurrently transmitting the driving signals on a basis of the pixel data retained in the second latch circuits of one of the second latch circuit groups to the plurality of driving sections corresponding to one of the liquid discharge pore rows after the delay time set for each of the second latch circuit groups has expired.

8. The recording method according to claim 7, further comprising:

setting the delay times set for each of the second latch circuit groups to be longer when a flight distance of the liquid becomes shorter, wherein the flight distance is a distance from the liquid discharge pores to the recording medium on which a discharged liquid lands.

9. The recording apparatus according to claim 8, further comprising:

preparing, as the data of the driving signals, a plurality of kinds of data depending on a liquid discharge amount and the flight distance; and wherein the driving signals include an initial standby time until an initial voltage change occurs in the driving signals, the initial standby time becoming longer with increasing the liquid discharge amount, and when a comparison is made between the driving signals having different flight distances, a difference of the initial standby time in the driving signals having different liquid discharge amounts increases with increasing the flight distance.

10. The recording method according to claim 7, further comprising:

preparing, as the data of the driving signals, a plurality of kinds of data depending on a liquid discharge amount; and wherein the driving signals include an initial standby time until an initial voltage change occurs in the driving signals, the initial standby time becoming longer with increasing the liquid discharge amount.

11. The recording method according to claim 7, further comprising:

preparing, as the data of the driving signals, a plurality of kinds of data having different initial standby times until an initial voltage change occurs in the driving signals; and wherein the driving signals having the different initial standby times are transmitted to the driving sections corresponding to the liquid discharge pores adjacent to each other in the liquid discharge pore row.

* * * * *